US005243918A

United States Patent [19]

Bounds

[11] Patent Number: 5,243,918

[45] Date of Patent: Sep. 14, 1993

[54] RAILROAD TRACK LAYING SYSTEM WITH MULTIPLE RAILROAD TIE HANDLING

[75] Inventor: Ivan E. Bounds, St. Joseph, Mo.

[73] Assignee: Herzog Contracting Company, St. Joseph, Mo.

[21] Appl. No.: 883,586

[22] Filed: May 13, 1992

Related U.S. Application Data

[63] Continuation-in-part of Ser. No. 746,067, Aug. 12, 1991, abandoned.

[51] Int. Cl.[5] ..... E01B 29/05

[52] U.S. Cl. ..... 104/2; 104/5; 104/7.1

[58] Field of Search ..... 104/2, 3, 5, 7.1

[56] References Cited

U.S. PATENT DOCUMENTS

| | | | |
|---|---|---|---|
| 3,633,513 | 1/1972 | Plasser | 104/2 |
| 4,000,699 | 1/1977 | Scheuchzer et al. | 104/3 |
| 4,979,247 | 12/1990 | Buhler | 104/5 |

FOREIGN PATENT DOCUMENTS

| | | | |
|---|---|---|---|
| 1019454 | 1/1953 | France | 104/2 |
| 1145715 | 10/1957 | France | 104/2 |
| 7806148 | 12/1979 | Netherlands | 104/3 |

*Primary Examiner*—Mark T. Le
*Attorney, Agent, or Firm*—Litman, McMahon & Brown

[57] ABSTRACT

A multiple railroad tie handling method includes simultaneously clamping a layer of closed packed, parallel concrete railroad ties, lifting and moving the clamped group toward a track bed, spreading the clamped ties to the required tie interval spacing, laterally aligning the clamped group with previously laid ties and spacing the group to continue the existing tie spacing, lowering the clamped group to the track bed, and simultaneously releasing the ties on the track bed. A multiple railroad tie handling apparatus includes a rectangular frame with tie clamp guides positioned along sides of the frame, a plurality of tie clamp support beams slidably engaging the guide tracks, a pair of padded tie clamp fingers pivotally mounted on the opposite ends of each beam, a clamp cylinder engaged between each clamp finger and the beam supporting it, a split lazy tong linkage arrangement connecting the beams to maintain them parallel, and a pair of tie spreading cylinder connected between linkage halves of the linkage arrangement.

22 Claims, 13 Drawing Sheets

168
192
196
198
174
178
110

130
204
106
147
200
146
131

18.
168
192
188
172
194
196
198
110
186
190
180
182
170
184
166
154

110
168
174
178

38.
38.
33.
33.
30.
30.
290
292
294
296
332
336
401
402
404
405
412
413
414
425
426
432
436
437
445
446
450
451
455
475
109

31.
32.

RAILROAD TRACK LAYING SYSTEM WITH MULTIPLE RAILROAD TIE HANDLING

This application is a continuation-in-part of U.S. patent application No. 746,057, filed on Aug. 12, 1991, now abandoned.

FIELD OF THE INVENTION

The present invention relates to railroad construction methods and apparatus and, more particularly, to a multiple railroad tie handling method and apparatus.

The present invention also relates to systems for laying railroad tracks, and particularly to such a system which utilizes a rail handling apparatus and method for engaging, lifting, transporting, spreading and lowering multiple railroad ties including both wood and concrete railroad ties.

BACKGROUND OF THE INVENTION

Under certain circumstances, railroads are one of the more energy efficient methods of transporting both passengers and freight. There has been a movement toward railed mass transit systems in many large cities for many reasons, including the conservation of petroleum consumed by automobiles of commuters and the emissions and traffic problems resulting from large numbers of low occupancy vehicles. While such railed mass transit systems have been proposed in many cities, the costs of right of way acquisition, construction of the railroad itself and passenger stations, the cost of purchasing rolling stock, and the like are all very high. While mass transit systems would save riders the costs of operating their automobiles for commuting and would, to some extent, reduce the cost of street maintenance, funds for construction of new railed systems and extensions and maintenance of existing systems are often difficult to obtain.

Even with the best conventional machinery available, the construction of railroads, like many other types of construction, is labor intensive. Thus, any tool or method which can increase the productivity of railroad construction workers, without compromising their safety or the quality of their work, is desirable from an economic standpoint. Additionally, anything which can increase the useful life of a railroad and its structural components is economically desirable Most existing railroads in this country are constructed using wooden cross ties positioned on a track bed of crushed rock. The rails are secured to the ties by large spikes. Since conventional wooden ties usually weigh in the neighborhood of a hundred pounds, they are usually hefted into place on the track bed manually. Such work is arduous, and injuries to workers performing such labor are not uncommon. Additionally, construction process is slow.

While the use of wooden railroad cross ties has many advantages, it also has disadvantages. Wooden ties are chemically treated to resist deterioration; however, such treatments do not extend to great depths within the ties. The effects of weathering and load bearing can cause cracks in the ties which expose untreated portions of the ties to additional weathering and destructive insects and molds. Regular inspection, maintenance procedures, and, often, replacement of wooden ties is required to avoid possible rail accidents caused by the deterioration of the ties.

In an effort to extend the life of railroad structural components and lessen maintenance costs, reinforced concrete cross ties have been developed and are being used in some new railroad construction. Although not entirely immune to some long term weathering effects, concrete ties are not susceptible to insect and mold deterioration and, thus, are projected to have significantly longer useful lives. One problem with concrete ties is that they weight considerably more than wooden ties, ranging from about six to eight hundred pounds per tie depending on the rail gauge and expected load capacity. At such a weight, lifting machinery is required for coarse positioning of the concrete ties, with final alignment and spacing performed using hand tools. Even with such machinery, little saving in labor has been realizable, and construction progress may actually be slower with concrete ties than with wooden ties. Additionally, the great weight of concrete ties increases the severity of hazards to workers handling such ties. The economic advantage of longevity of concrete over wooden ties is offset to some extent by higher costs in the manufacture and installation of concrete ties.

SUMMARY OF THE INVENTION

The present invention provides an improved railroad track laying system including an improved method of laying railroad cross ties, particularly concrete ties, and a railroad tie handling apparatus for carrying out such a method. In general, the multiple railroad tie handling method of the present invention includes the steps of simultaneously clamping the ends of a layer of closely packed ties from a stack of such layers, lifting the clamped ties and moving them over the prepared track bed, spreading the ties to the required tie interval spacing while moving toward the track bed, laterally aligning the clamped group of ties positioning the clamped group of ties to continue the established tie interval spacing already established, lowering the group to the track bed, and simultaneously releasing the group of ties in place on the track bed.

The multiple tie handling apparatus of the present invention includes a rectangular frame with tie clamp guide tracks positioned along its sides, a plurality of clamp support beams slidably engaged with the guide tracks, padded clamp fingers pivotally mounted at opposite ends of the clamp support beams, a clamp cylinder associated with each clamp finger and pivotally connected between the clamp finger and the clamp support beam on which it is mounted, a split lazy tong type of linkage with linkage halves thereof connected to the clamp support beams at spaced apart locations therealong to maintain the parallel relationship of the ties when spread, tie spacing cylinders connected between the linkage halves to spread and converge the tie clamp beams, hydraulic controls connected to and controlling the clamp cylinders and tie spacing cylinders, and a source of pressurized hydraulic fluid. The hydraulic source may be provided by a mobile hydraulic lifting machine to lift the tie handling apparatus between a tie stack and the track bed, such as a backhoe type of excavator, a truck mounted lift boom, or the like.

The stacks of ties may be delivered to the work site on flat bed trucks, and may be transferred directly from the stacks on the truck to the track bed using the multiple tie handling apparatus as the truck follows along with the mobile lifting machine. This results in additional savings in labor, time, and machinery, since it is often not necessary to offload and subsequently reposition the stacks of ties. Using the multiple tie handling method and apparatus of the present invention, it has been demonstrated that a crew of three workers, including a lift machine operator and two workers to control and finely position the tie handling apparatus, can lay about twelve hundred concrete ties in a standard work day. This compares very favorably with conventional method of laying concrete ties in which a crew of about ten to twelve workers may only lay about five hundred ties in the same work day. After the ties have been released by the tie handling apparatus, only minimal manual fine positioning is required.

OBJECTS AND ADVANTAGES OF THE INVENTION

The principal objects of the present invention are: to provide an improved railroad track laying system; to provide an improved method and apparatus for laying railroad cross ties along a track bed; to provide such a method and apparatus which significantly increase the rate at which ties are laid and the productivity of workers laying such ties; to provide such a tie laying method which includes lifting an entire layer of closely packed ties from a stack of such layers, spreading the ties to the required tie spacing on the track bed, and depositing the ties on the prepared track bed in alignment with previously laid ties; to provide such a method which minimizes manual handling of the ties and thereby decreases the hazards to workers performing such labor; to provide a multiple tie handling apparatus for performing such a tie laying method; to provide such an apparatus which includes a plurality of tie clamps guided by tracks on a rectangular frame and a linkage connected to the clamps which maintain parallelism of the ties as they are spread; to provide such an apparatus in which the ties are clamped by their ends with padded clamp fingers; to provide such an apparatus which employs hydraulic cylinders for tie clamping and spreading functions; to provide such an apparatus which is adapted for use with a variety of conventional mobile lifting mechanisms having the necessary lifting capacity, such as backhoe excavator type machines, truck mounted lift booms, and the like; to provide such an apparatus which is sized and strengthened to simultaneously handle groups of reinforced concrete railroad ties; to provide such an apparatus which is also adaptable to end clamp, space, and place groups of conventional wooden railroad ties and other similar types of structural members; and to provide such multiple railroad tie handling methods and apparatus which are economical to manufacture and practice and which are particularly well adapted for their intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

Figure 22:
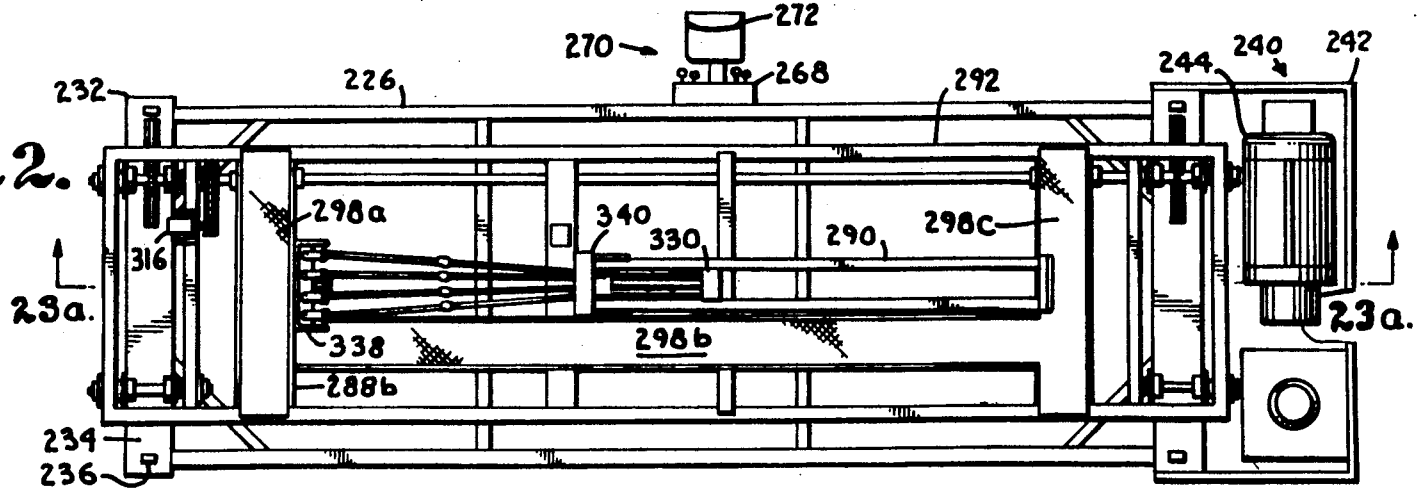
FIG. 22 is a fragmentary, top plan view thereof, particularly showing the gantry.

FIG. **23*a* is an enlarged, fragmentary, vertical, cross-sectional view thereof, taken generally along line 23*a*—23*a* in FIG. 22**.

Figure 24:
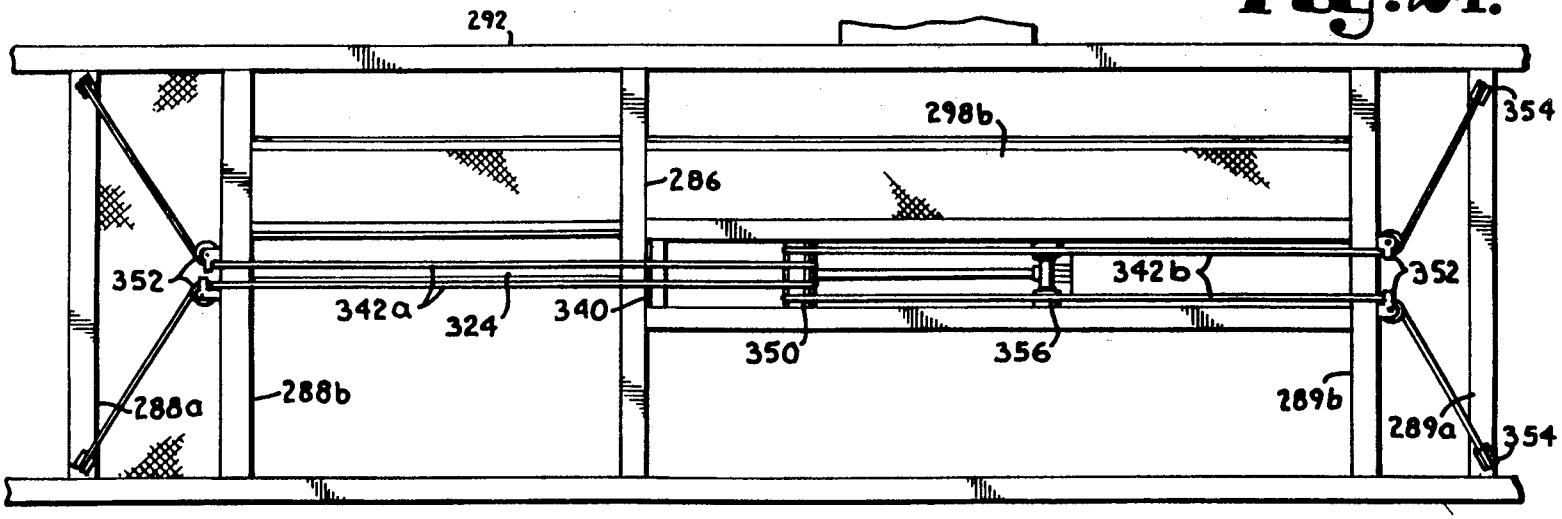

FIG. 24 is an enlarged, fragmentary, horizontal, cross-sectional view thereof, taken generally along line 24—24 in FIG. **23*a*** and showing the underside of a suspension frame for a modified or alternative embodiment railroad tie handling apparatus.

Figures 25, 26, 27:
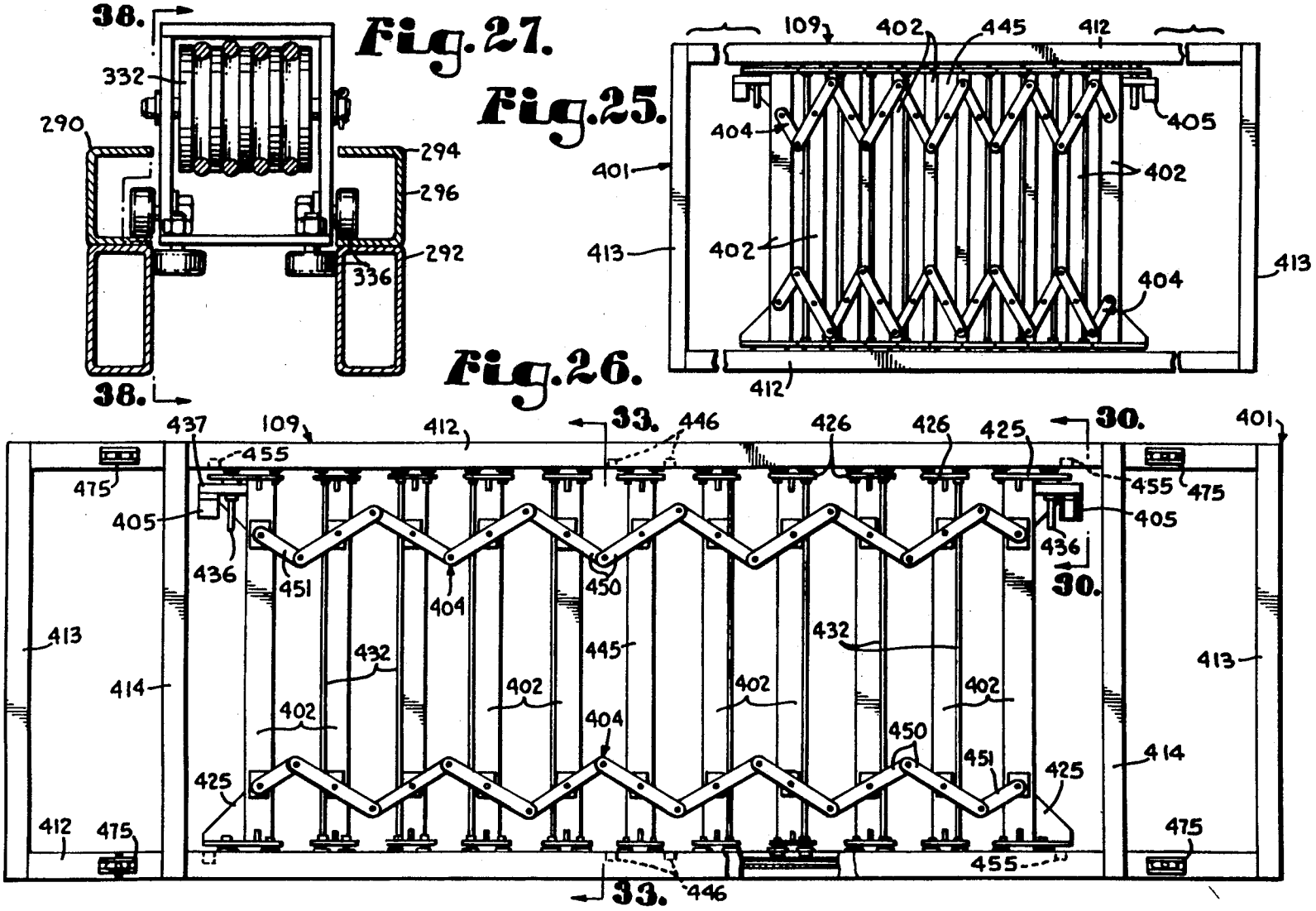

FIG. 25 is a fragmentary, top plan view of the railroad tie handling apparatus, particularly showing the crossbeams thereof spaced relatively closely together.

FIG. 26 is a fragmentary, top plan view of the railroad tie handling apparatus, particularly showing the crossbeams thereof spread apart.

Figure 23A:
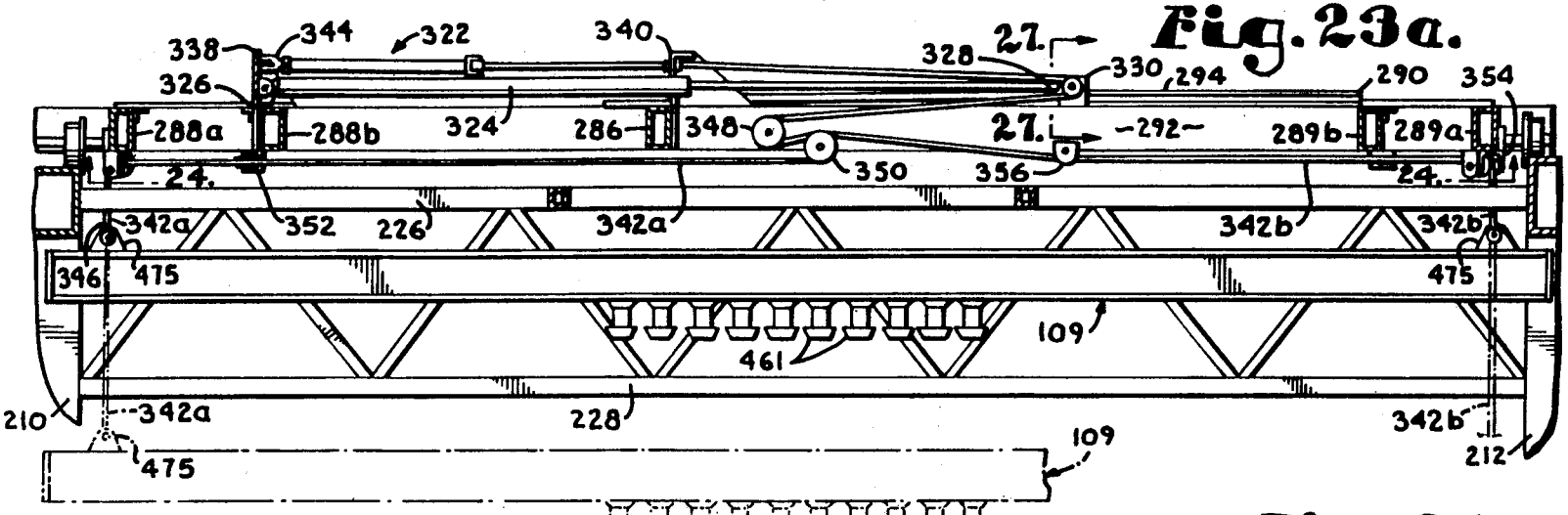
FIG. 23 is an enlarged, fragmentary, top plan view thereof.

FIG. 27 is an enlarged, fragmentary, vertical cross-sectional view of the system, taken generally along line 27—27 in FIG. 23*a*.

Figure 23:
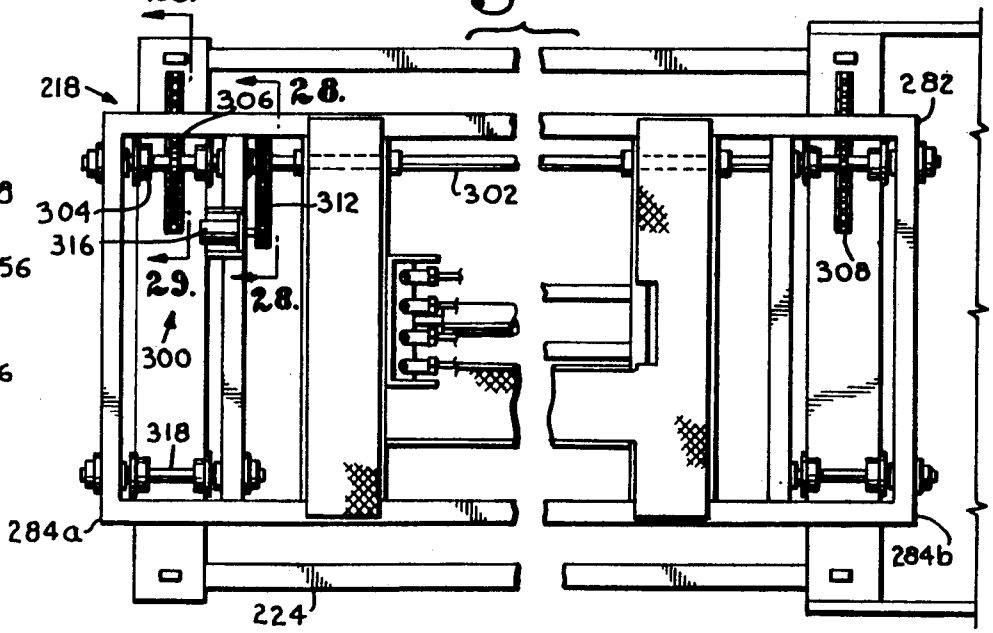
Figure 28:
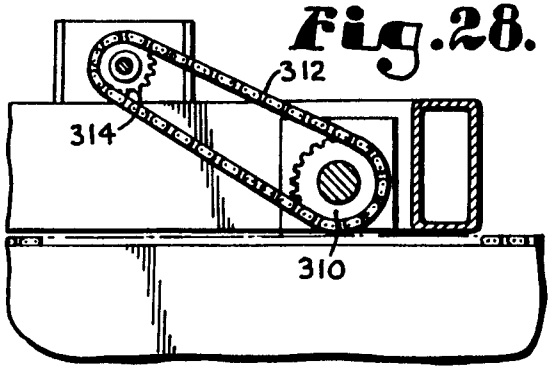

FIG. 28 is an enlarged, fragmentary, vertical cross-sectional view of the system, taken generally along line 28—28 in FIG. 23.

Figure 29:
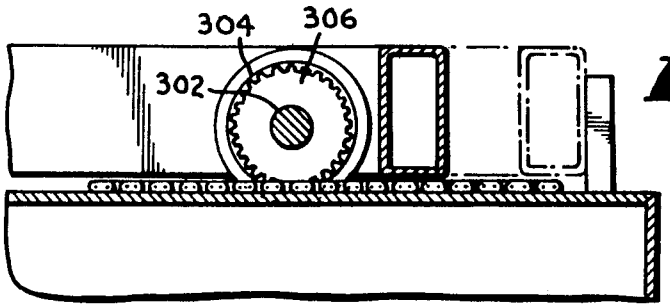

FIG. 29 is an enlarged, fragmentary, vertical cross-sectional view of the system, taken generally along line 29—29 in FIG. 23.

Figures 30, 31, 32, 33:
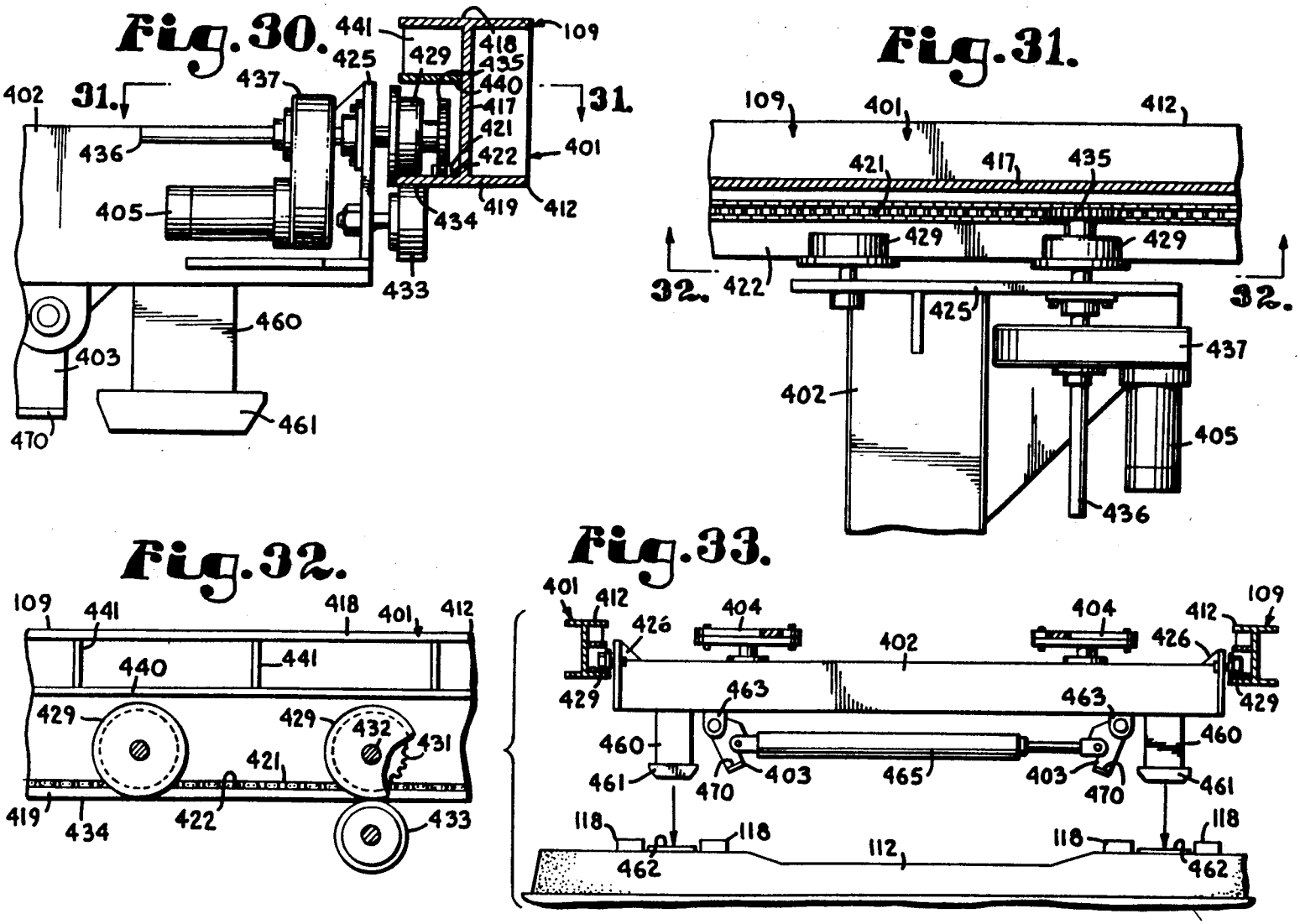

FIG. 30 is an enlarged, fragmentary, vertical cross-sectional view of the system, taken generally along line 30—30 in FIG. 26.

FIG. 31 is an enlarged, fragmentary, top plan view thereof, taken generally along line 31—31 in FIG. 30.

FIG. 32 is an enlarged, fragmentary, vertical, cross-sectional view thereof, taken generally along line 32—32 in FIG. 31.

FIG. 33 is an enlarged, fragmentary, vertical cross-sectional view of the system, particularly showing a railroad tie handling apparatus crossbeam being lowered into position to engage a concrete railroad tie.

Figure 34:
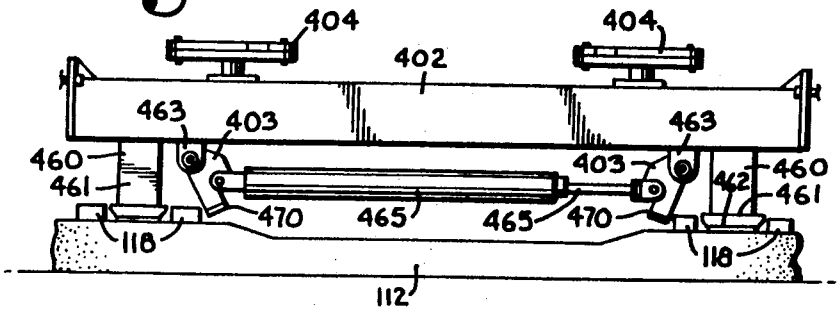

FIG. 34 is an enlarged, vertical, cross-sectional view thereof, showing the railroad tie handling apparatus crossbeam in place on a concrete railroad tie immediately prior to engagement for lifting.

Figure 35:
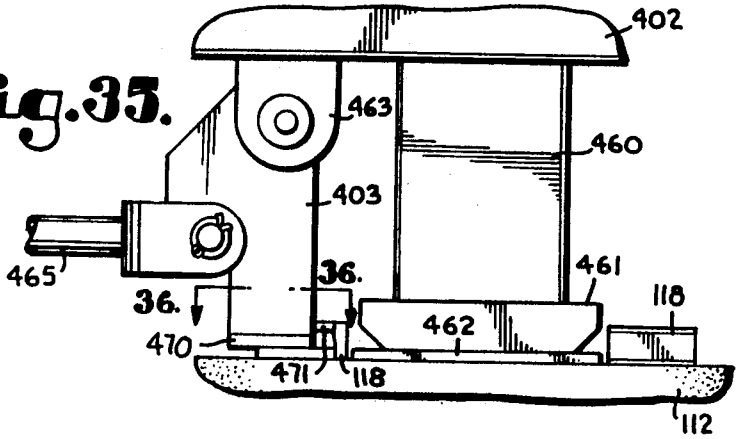

FIG. 35 is an enlarged, fragmentary, vertical cross-sectional view thereof, particularly showing a concrete tie engaged by one end of the railroad tie handling apparatus crossbeam.

Figure 36:
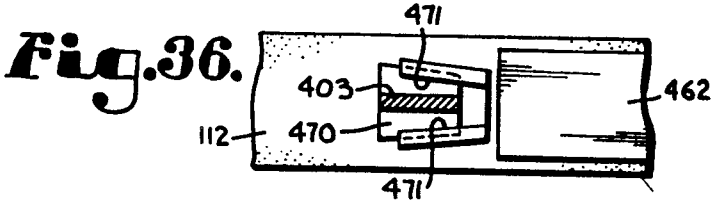
Figure 15:
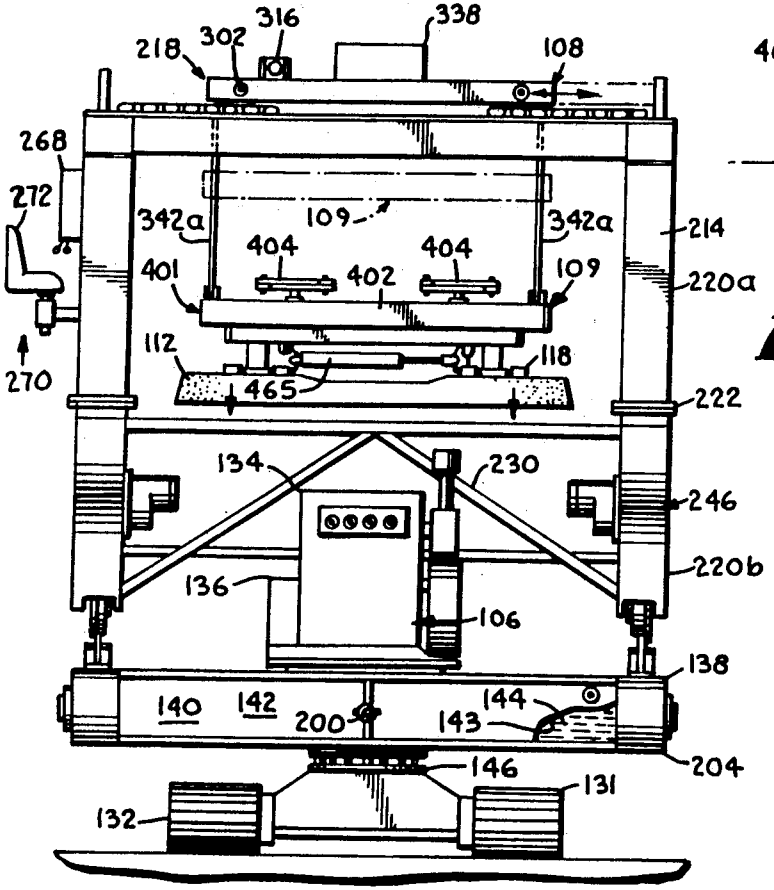
FIG. 15 is an enlarged, vertical, cross-sectional view of the system taken generally along 15—15 in FIG. 13
Figures 17, 18, 19, 20:
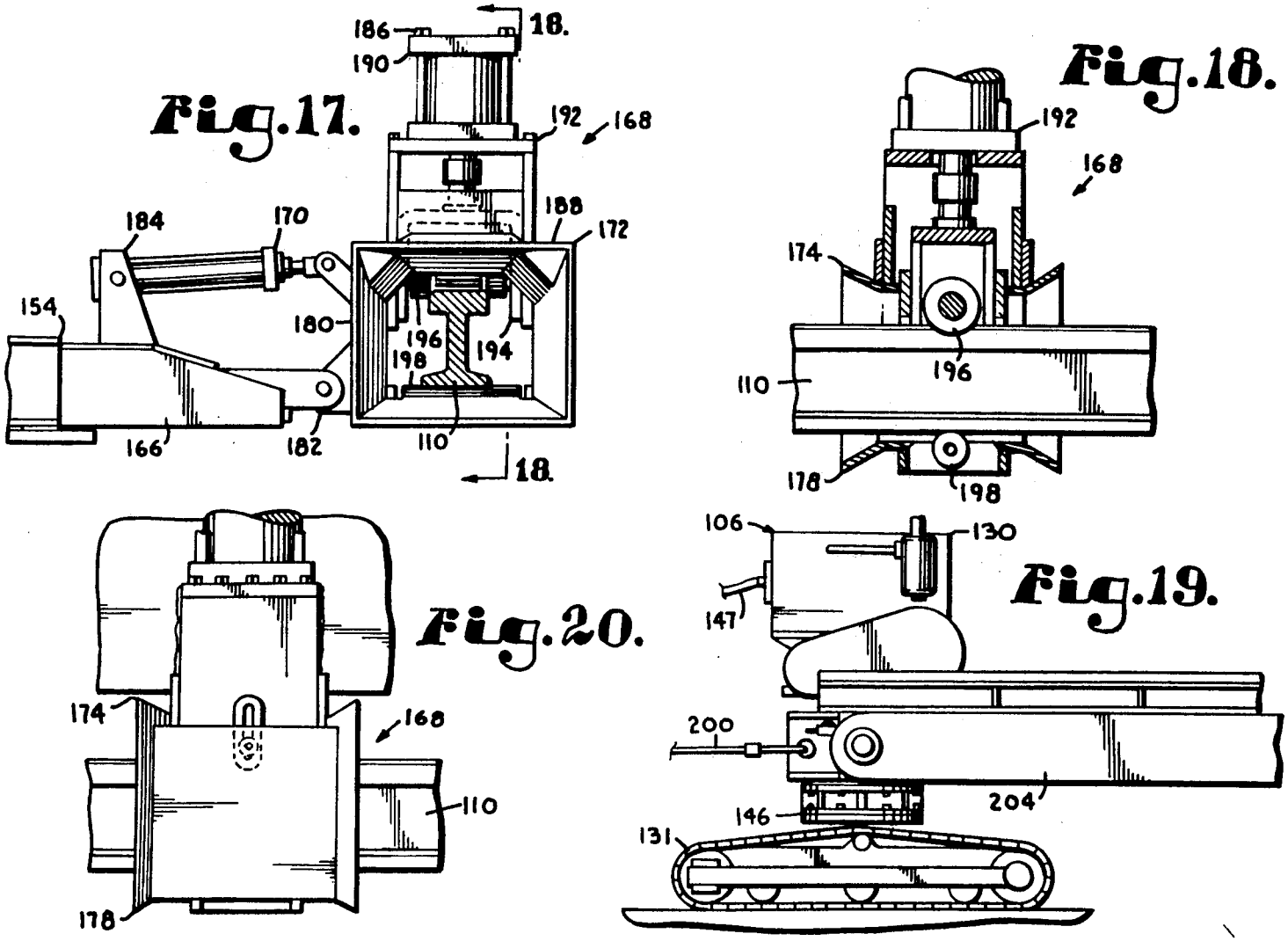
FIG. 17 is an enlarged, fragmentary, vertical, cross-sectional view of the system, taken generally along line 17—17 in FIG. 13.
FIG. 18 is a vertical, cross-sectional view of the system taken generally along line 18—18 in FIG. 17.
FIG. 19 is an enlarged, side elevational view of the system taken generally along line 19—19 in FIG. 15.
FIG. 20 is an enlarged, fragmentary, side elevational view of the system, particularly showing a rail guide assembly.
Figure 21:
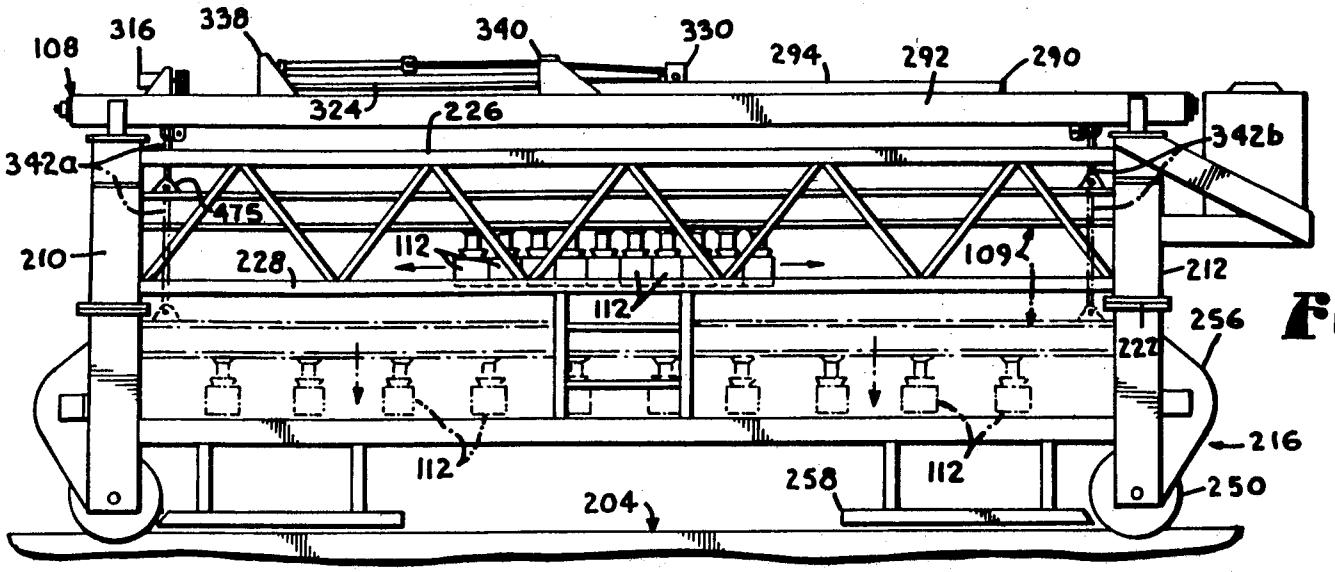
FIG. 21 is fragmentary, side elevational view thereof, particularly showing a gantry.

FIG. 36 is an enlarged, horizontal, cross-sectional view thereof, taken generally along line 36—36 in FIG. 35.

Figure 37:
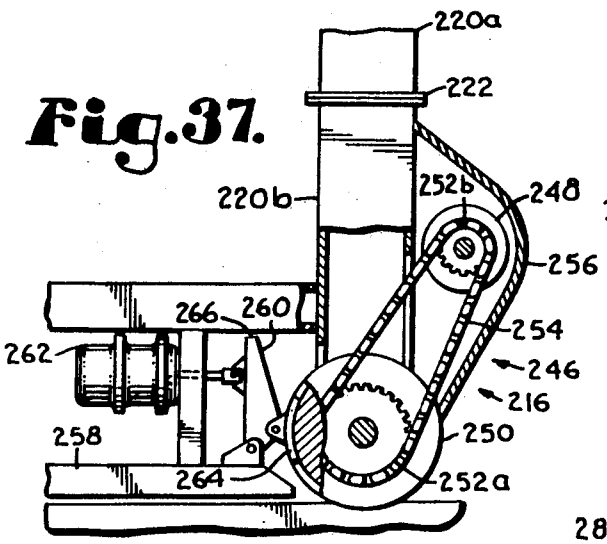

FIG. 37 is an enlarged, fragmentary, side elevational view thereof, particularly showing a gantry drive subassembly.

Figure 38:
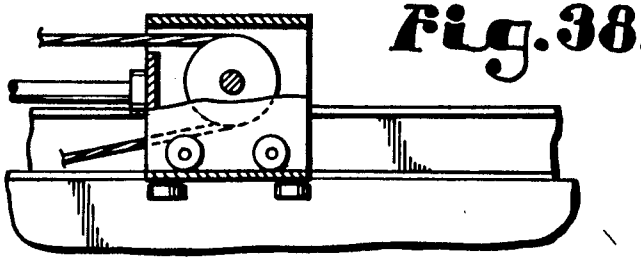
Figure 16:
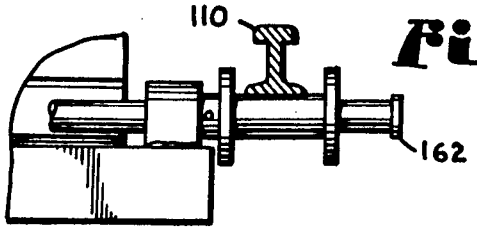
FIG. 16 is an enlarged, fragmentary, vertical, cross-sectional view of the system, taken generally along line 16—16 in FIG. 14.

FIG. 38 is an enlarged, fragmentary, vertical cross-sectional view thereof, particularly showing a pulley head and taken generally along line 38—38 in FIG. 27.

Figure 39:
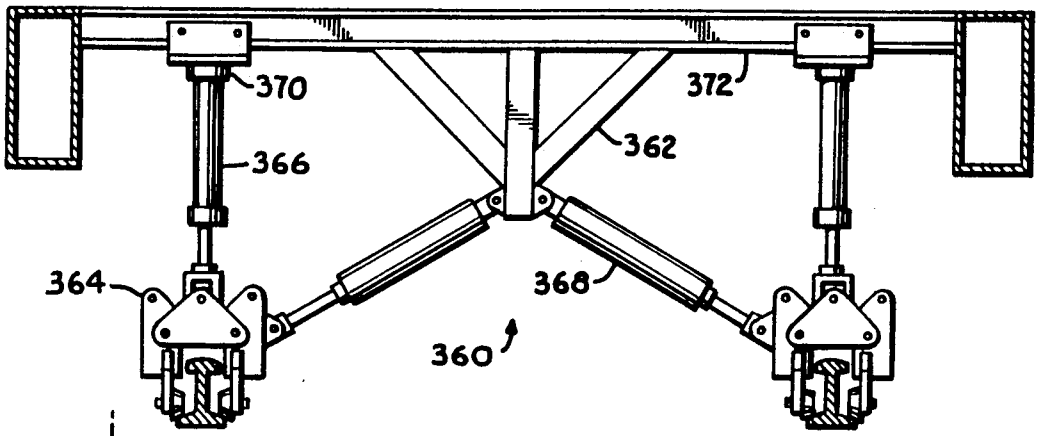

FIG. 39 is an enlarged, fragmentary, vertical cross-sectional view thereof, particularly showing a rail spacing subsystem.

Figure 40:
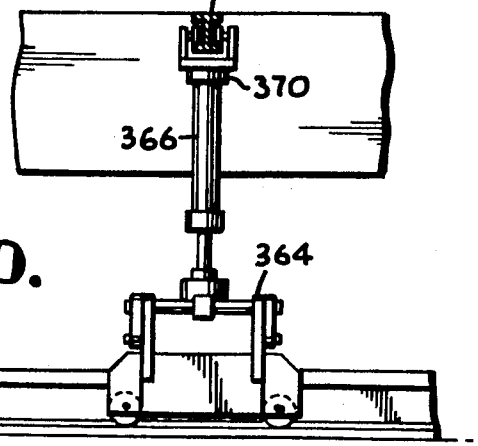

FIG. 40 is an enlarged, fragmentary, vertical cross-sectional view thereof, taken generally along line 40—40 in FIG. 39.

Figure 41:
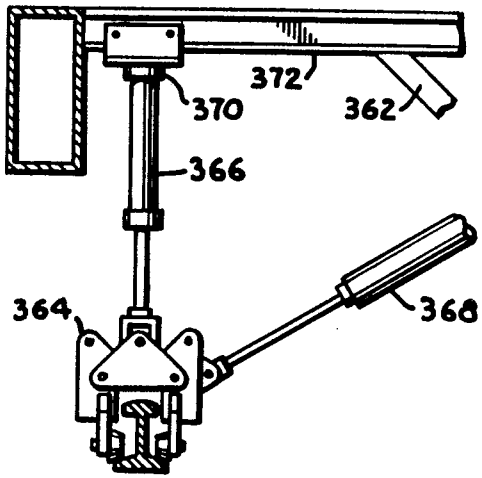

FIG. 41 is an enlarged, fragmentary, vertical cross-sectional view thereof, particularly showing the rail spacing subsystem.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. INTRODUCTION AND ENVIRONMENT

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

II. RAILROAD TIE HANDLING APPARATUS AND METHOD

Referring to the drawings in more detail:

The reference numeral 1 generally designates a multiple railroad tie handling apparatus embodying the present invention. The apparatus 1 generally includes an apparatus frame 2 with a plurality of tie clamps 3 slidably mounted thereon. The tie clamps 3 are interconnected by a linkage arrangement 4 (FIG. 3) which maintains a parallel relationship of the clamps 3 when spread and converged. A pair of tie spacing cylinders 5 (FIG. 3) are connected between halves of the linkage arrangement 4 and are operated to spread and converge the tie clamps 3. In general, the tie clamps 3 are converged to simultaneously clampingly engage a plurality of concrete railroad ties 6, the frame 2 is lifted and moved toward a track bed 7, the tie clamps 3 are spread to space the ties 6 at a required tie interval spacing, the group of ties 6 is aligned with previously laid ties B and spaced in relationship thereto, the group of ties 6 is placed onto the track bed 7, and the group of ties 6 is simultaneously released.

Figure 1:
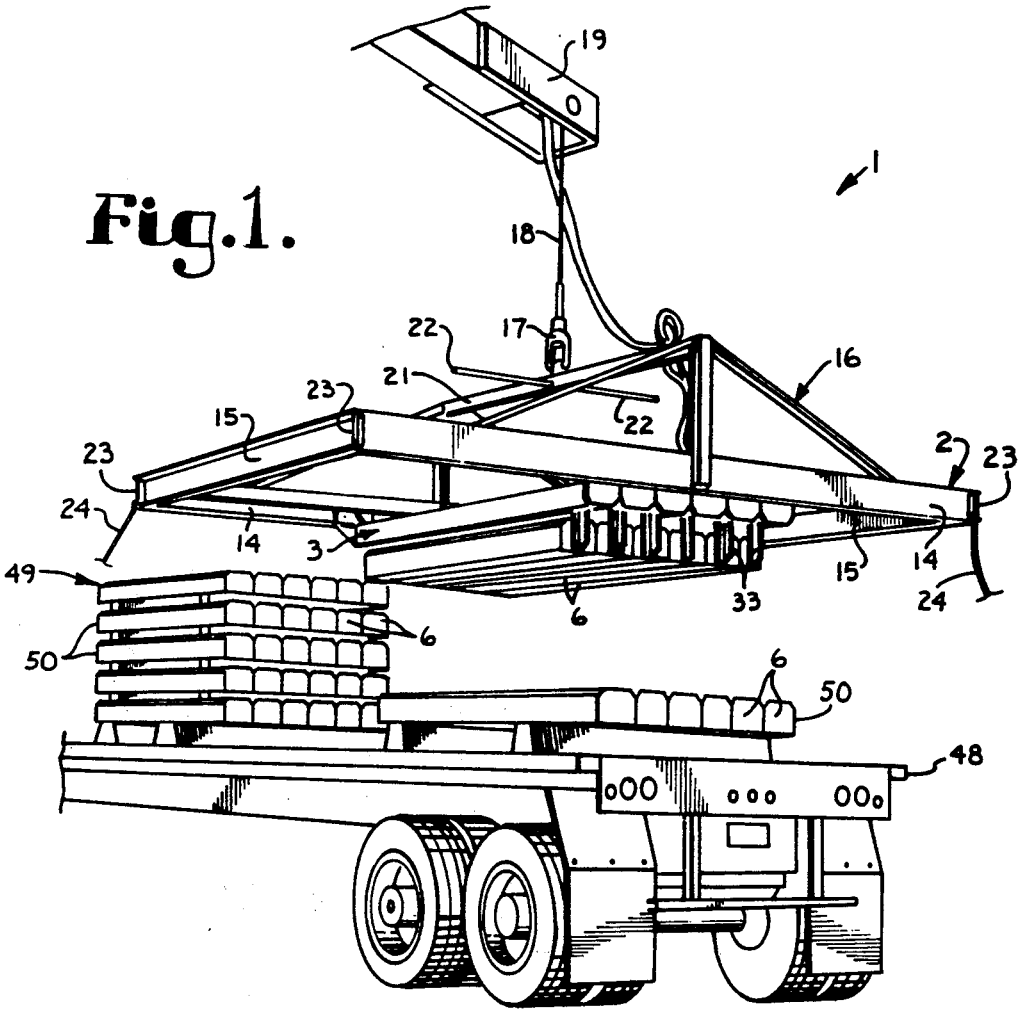
FIG. 1 is a perspective view of a multiple railroad tie handling apparatus embodying the present invention and shown lifting a layers of ties from a stack on a flat bed truck.
Figure 5:
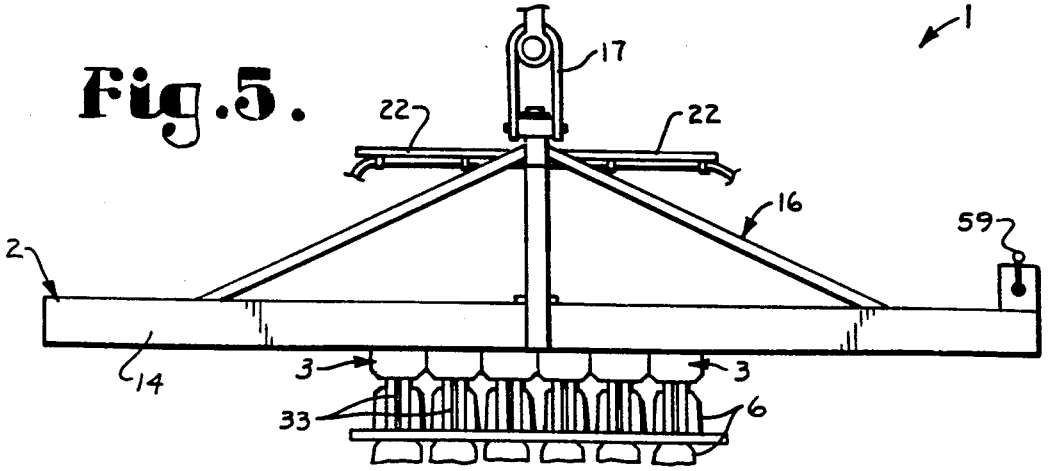
FIG. 5 is a fragmentary enlarged side elevational view of the tie handling apparatus with the tie clamps converged and engaging a layer of ties.
Figure 9:
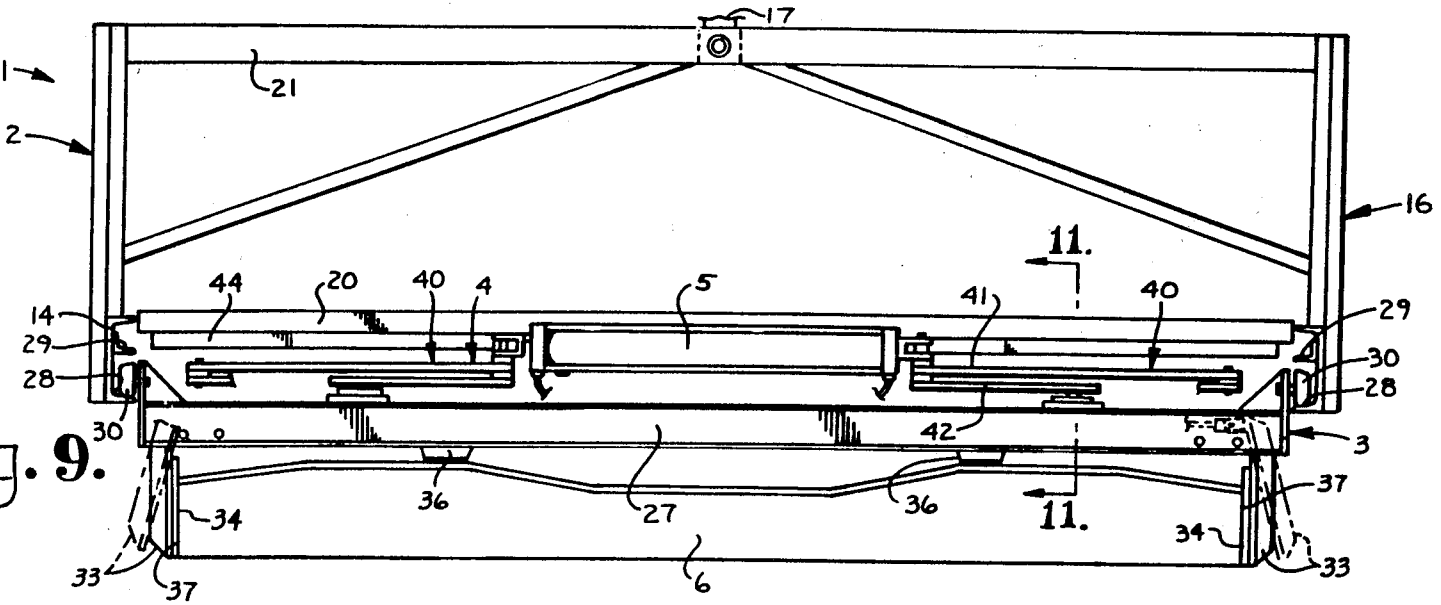
FIG. 9 is a further enlarged transverse sectional view of the tie handling apparatus taken along line 9—9 of FIG. 6 and illustrates details of a clamp spacing cylinder and clamp linkage thereof.
Figure 12:
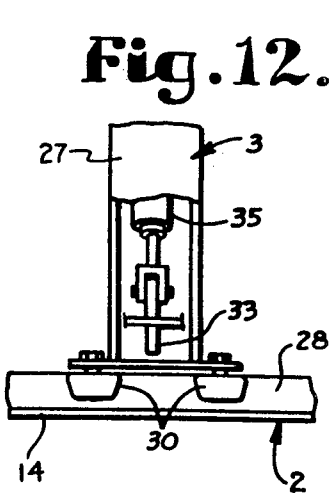
FIG. 12 is a greatly enlarged fragmentary top plan sectional view taken along line 12—12 of FIG. 10 and illustrates further details of clamp end rollers and guide track of the tie handling apparatus.

Referring particularly to FIGS. 1, 5, and 9, the apparatus frame 2 is formed of elongated channel members connected in a rectangular shape. Longer side members 14 open inwardly (see FIG. 9) while shorter end members 15 open outwardly. The frame 2 includes a superstructure or lifting yoke 16 which stiffens the frame 2 and provides a mounting point for a clevis 17 at an apex thereof for the attachment of a chain or cable 18 which is in turn connected to a boom 19 of a mobile lifting machine, such as a backhoe type excavator (not shown). A lower center member 20 extends between the side members 14 above which an upper center member 21 extends between side trusses of the lift yoke 16 and has a pair of hydraulic supporting struts 22 extending from opposite sides thereof. The clevis 17 is attached to the upper center member 21 at the center of gravity of the frame 2 such that when the apparatus 1 is lifted, it is relatively balanced. Preferably, the corners of frame 2 are provided with handles 23 which allow manual grasping to control the position of the lifted apparatus 1 and to which steadying ropes 24 are tied to control the apparatus 1 when lifted and moved.

Figure 10:
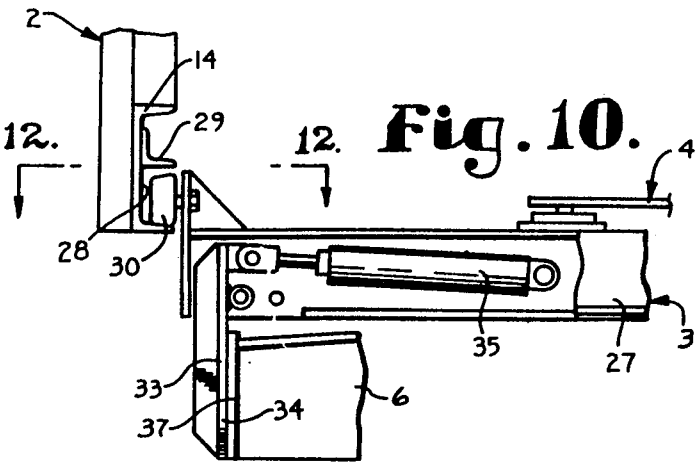
FIG. 10 is a greatly enlarged fragmentary view similar to FIG. 9 and illustrates details of a clamp finger actuating cylinder and a clamp end guide roller and track.

Referring to FIGS. 9 and 10, each tie clamp 3 includes a tie clamp beam 27 which extends across the frame 2 between the side members 14 parallel to the end members 15. The opposite ends of the beams 27 engage tie clamp guide tracks 28. The tracks 28 are formed by lower flanges of the side member channels 14 and angle members 29 extending along the insides of the webs of the channels 14. The ends of the beams 27 are provided with rollers 30 which engage the lower flanges of the channels 14 when the apparatus 1 is placed on the ground. The illustrated beams 27 are square cross section tubes.

The actual clamping members are clamp fingers or jaws 33 which are pivotally connected to the beams 27 at their opposite ends. The illustrated fingers 33 are T-shaped in cross section and are provided with resilient pads 34 on their inner sides to avoid damage to the ends of the ties 6 when clamped. Each clamp finger 33 has a hydraulic clamp cylinder 35 pivotally connected between the beam 27 and an upper end of the clamp finger 33. The under sides of the beams 27 are provided with landing pads 36 with resilient lower surfaces, to properly spaced the clamp fingers 33 relative to the ends 37 of the ties and to avoid damage to the ties 6 when the apparatus 1 is rested on a group of ties 6 for engagement of the clamp fingers 33 therewith. The hydraulic clamp cylinders 35 of all the tie clamps 3 are connected in parallel for simultaneous operation to close and clamp the ties 6 or to open and release the ties.

Figure 3:
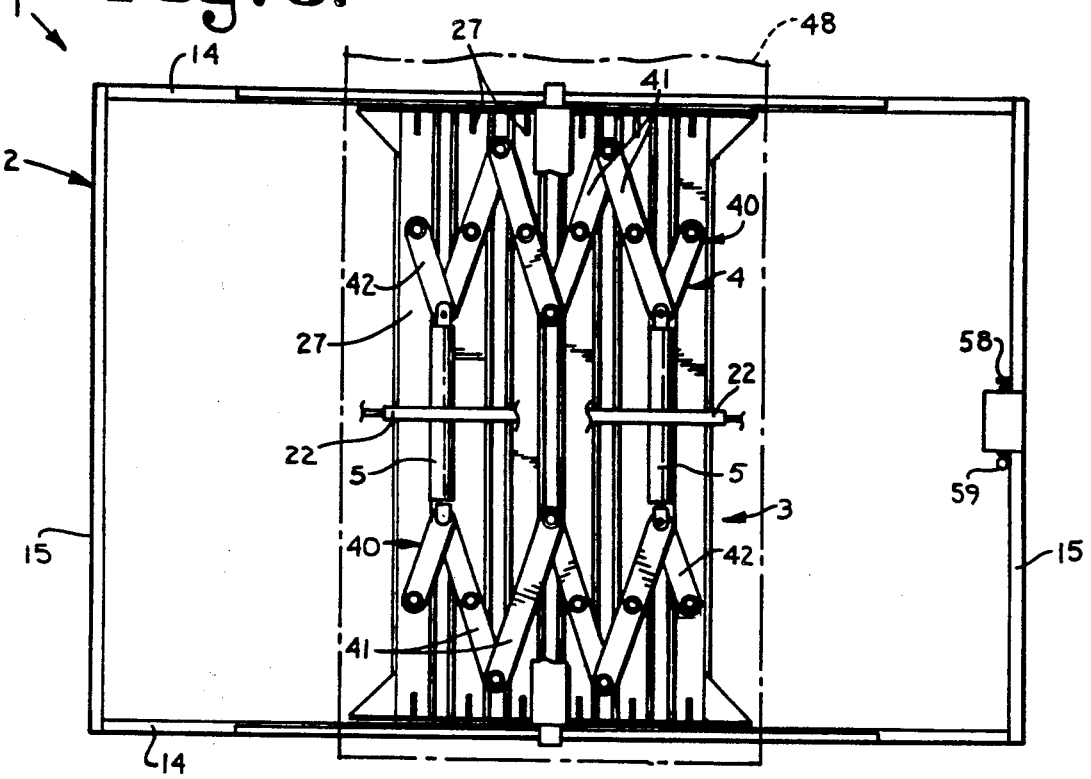
FIG. 3 is an enlarged top plan view of the tie handling apparatus with the tie clamps shown in converged relationship for clamping a layer of ties from a supply stack.
Figure 4:
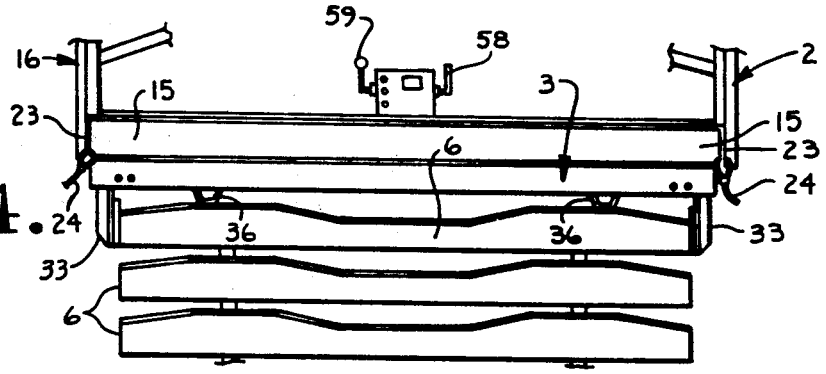
FIG. 4 is a fragmentary enlarged end elevational view of the tie handling apparatus and illustrates an end tie clamp engaged with a concrete railroad tie.
Figure 6:
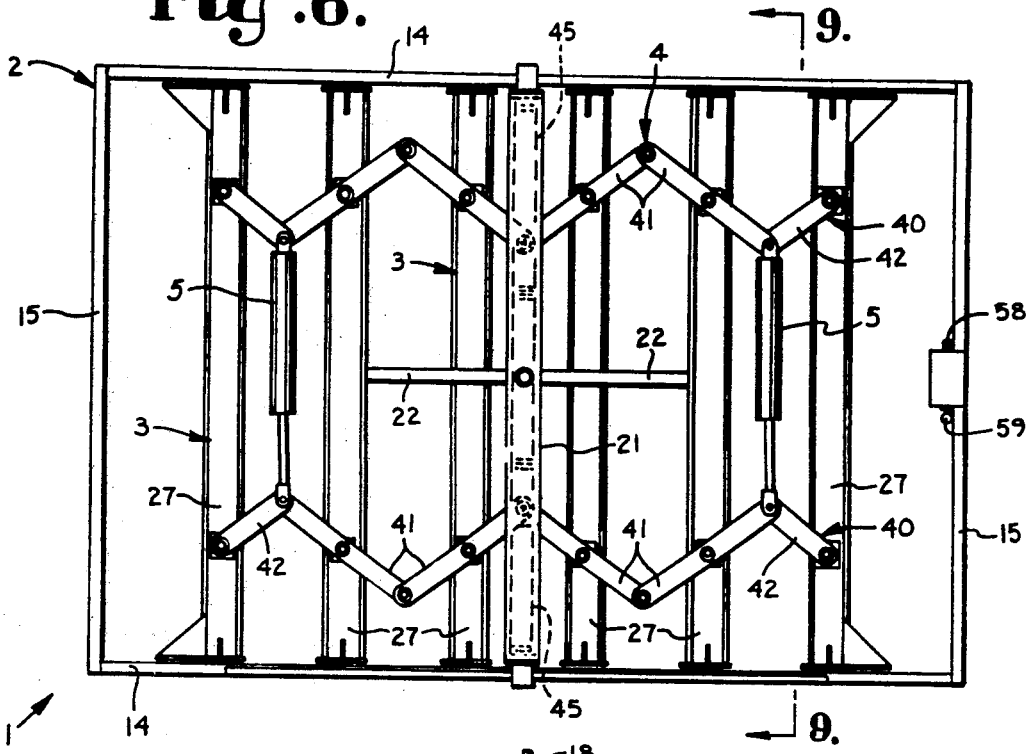
FIG. 6 is a view similar to FIG. 3 and illustrates the tie clamps in a spread relationship.
Figure 7:
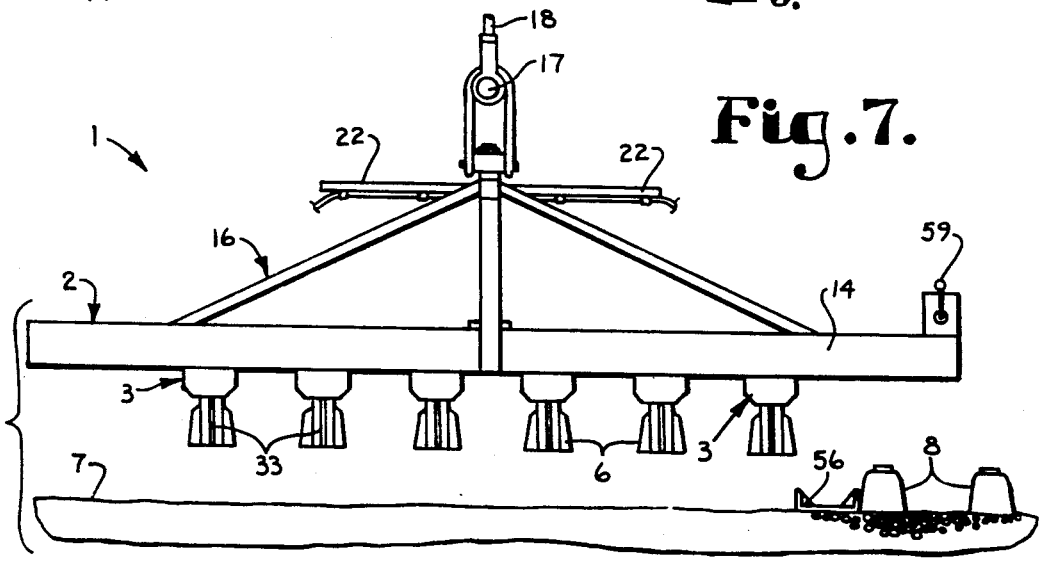
FIG. 7 is a view similar to FIG. 5 and illustrates the tie clamps spread and positioned to lower a group of ties onto a railroad track bed.
Figure 8:
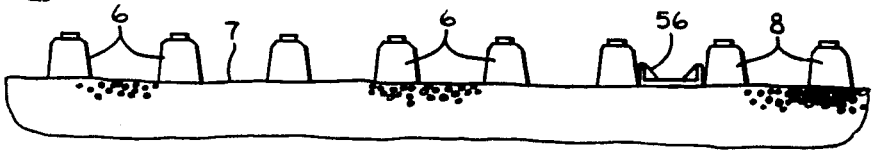
FIG. 8 is a fragmentary side elevational view of a railroad track bed and illustrates a tie group spacing template to facilitate positioning a group of ties to continue the spacing of previously laid ties.
Figure 11:
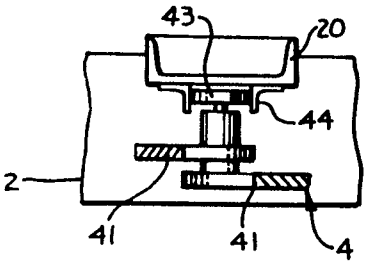
FIG. 11 is a greatly enlarged fragmentary sectional view taken along line 11—11 of FIG. 9 and illustrates details of a linkage guide of the tie handling apparatus.

Referring to FIGS. 3, 6, and 11, the beams 27 are interconnected by the linkage arrangement 4 which is a guided split lazy tong or accordion type of linkage arrangement. The linkage 4 simultaneously transfers movement from the tie spacing cylinders 5 to the beams 27 and maintains a parallel relationship of the beams 27 during spreading and converging of the tie clamps 3. The linkage 4 is formed in linkage halves 40 which are pivotally connected to the beams 27 near opposite ends thereof. Each linkage half 40 includes full links 41 interconnecting inner ones of the beams 27 and half links 42 connected to the outer beams 27. The illustrated tie spacing cylinder 5 are connected between joints connecting the half links 42 and the outermost full links 41 of each of the linkage halves 40. Expansion of the cylinders 5 causes the beams 27 to be spread apart while retraction of the cylinders 5 converges the beams.

The configuration of the linkage 4 maintains equal spacing between the beams 27 as they are spread and converged. Additionally, the linkage 4 substantially maintains the balance of the apparatus 1 when lifted by spreading the tie clamps 3 with ties 6 evenly on either side of the center of gravity of the frame 2, which is represented by a vertical axis of rotation of the clevis 17. The movement of the members of the linkage halves 40 is constrained by the engagement of linkage guide rollers 43 with a linkage guide track 44 positioned on the under side of the lower center member 20. The rollers 43 are mounted on the joints connecting the centermost full links 41. Engagement of the rollers 43 with the track 44 causes the beams 27 to remain mutually parallel during spreading and converging. The linkage guide track 44 is provided with stop members 45 which are engaged by the rollers 43 when the tie clamps 3 have been spread to the desired tie interval spacing. The stop members 45 may be replaced with other stops 45 of different sizes to vary the maximum spacing between the ties 6. The tie spacing cylinders 5 are connected in parallel for simultaneous operation.

The reinforced concrete railroad ties 6 may be delivered to the work site on flat bed trucks 48. The ties 6 are positioned in stacks 49 formed of layers 50 of ties 6 in parallel touching relationship. Each of the ties 6 weighs from six hundred to eight hundred pounds depending on its dimensions, and the illustrated apparatus 1 is provided with six tie clamps 3 to simultaneously handle six ties. The tie clamps 3 are generally adapted to handle one particular length of tie, but the spacing between the ties 6 as positioned on the track bed 7 may be varied, as described above. The apparatus 1 simultaneously clamps an entire layer 50 of the ties 6 positioned in side-by-side touching relationship, spreads the ties to the required track bed tie interval spacing, and places the layer 50 of ties on the track bed.

Figure 2:
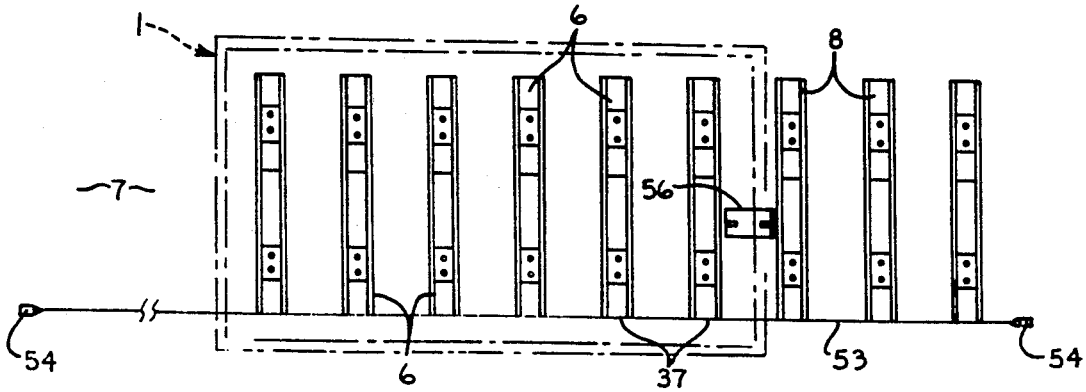
FIG. 2 is a diagrammatic plan view of a railroad track bed and illustrates tie alignment and group spacing arrangements for use with the tie handling apparatus and method of the present invention.

FIG. 2 illustrates tie alignment arrangements which may be used to properly position the group of ties using the apparatus 1. Lateral alignment of the ties 6 may be aided by fairly simple means, such as a string 53 extended between stakes 54 driven into the track bed 7 and forming a guide line for the ends 37 of the ties 6. Spacing of the clamped and spread layer 50 of ties 6 to continue the tie interval spacing of the previously laid ties 8 may be aided by the use of tie spacing template 56 which is positioned in contact with the last laid tie 8. The first of the group of ties 6 to be placed on the track bed 7 is positioned in contact with the template 56 to continue the required tie interval spacing.

After the apparatus 1 is rested upon a layer 50 of ties 6 to be laid, a hydraulic clamp lever 58 is operated to extend the clamp cylinders 35 to pivot the clamp fingers 33 into clamping arrangement with the ends 37 of the ties 6. The apparatus 1 is then lifted by the boom 19 of the lift machine a small clearance from the stack 49, a hydraulic spread control lever 59 is operated to extend the spacing cylinders 5, and the apparatus 1 is lifted further and swung toward the track bed 7. During movement of the apparatus 1 toward the track bed 7, the orientation of the frame 2 is controlled using the ropes 24. Signals between the workers steadying the apparatus 1 and the lift machine operator and some manual effort by the steadying workers allows positioning of the clamp group of ties 6 in lateral alignment with the string 53 and in contact with the spacing template 56. When the correct position of the clamped group of ties has been achieved, the apparatus 1 is fully lowered to rest the ties 6 on the track bed 7, and the clamp lever 58 is operated to cause the clamp cylinders 35 to retract to simultaneously release the ties 6 from the tie clamps 3. The apparatus 1 is lifted out of contact With the ties 6, and the spread control lever 59 is operated to cause the tie clamps 3 to be converged to ready the apparatus 1 to engage another layer 50 of ties 6.

While the apparatus 1 has been described and illustrated as adapted for handling reinforced concrete railroad ties, it may also be configured for handling conventional wooden ties. The use of the apparatus 1 with wooden ties has the same advantages as its use with concrete ties. The apparatus 1 may also be configured and used for engaging, spacing, and placing other types of elongated structural members besides railroad ties.

III. FIRST MODIFIED OR ALTERNATIVE EMBODIMENT RAILROAD TRACK LAYING SYSTEM 101, INTRODUCTION

A railroad track laying system comprising a first modified or alternative embodiment of the present invention is shown in FIGS. 13-38 and is generally designated by the reference numeral 101.

The track laying system 101 generally includes a tractor means or bulldozer 105, a bridging means or bridge structure 106, a tie supply means or railcars 107 and a gantry 108 having a railroad tie handling apparatus 109.

The railroad track laying system 101 is designed for laying rails 110 on rail ties 112 on a prepared roadbed 114 with a layer of ballast 116.

The ties 112 comprise concrete ties with two pairs of brackets 118 each for mounting the rails 110. The brackets 118 are partly embedded in the concrete ties 112 as they are manufactured and are used for lifting purposes in connection with the present invention. The brackets 118 comprise part of a "McKay" fastening system for fastening rails to concrete ties. A rail pad 120 comprising a resilient material, such as rubber, is placed between each pair of rail attachment brackets 118.

IV. TRACTOR MEANS OR BULLDOZER 105

The primary motive force for the track laying system 101 is provided by the tractor means 105, which can comprise bulldozer with suitable modifications, including a front rail handling system 152 and a rear rail handling system 154. The bulldozer 105 includes continuous tracks 150 for travel over the roadbed 114 at relatively low speeds with sufficient power to pull the track laying system 101.

The front rail handling system 152 comprises a sled base 156 which is pivotally mounted on the chassis of the bulldozer 105 for raising and lowering about a transverse pivotal axis by means of a pair of hydraulic piston-and-cylinder units 158. The sled base 156 mounts an articulated-arm crane 160, which is adapted for raising rails 10 or rail sections by means of tong-type clamping or gripping devices which are commonly used for this purpose. The crane 160 can be used for raising a rail 110 or rail section which has been placed alongside the roadbed 114 ahead of the track laying system 101, and placing it on one of a pair of rail guide rollers 162 which are mounted on opposite sides of the sled base 156. The rail guide rollers 162 function to space the rails 110 a predetermined distance apart as the track laying system 101 advances.

The rails 110 can be either spliced at the ends of respective rail sections or continuous welded rails (CWR) with the rail section ends welded together at butt joints.

The rear rail handling system 154 includes a rear platform 164 which can be hydraulically raised and lowered. The rear platform 164 mounts a pair of outrigger beam members 166 which ar laterally translatable with respect to each other by means of hydraulic piston-and-cylinder units. A pair of immediate rail guide assemblies 168 are mounted on the outboard ends of the outrigger beam members 166 and each is pivotable about a longitudinally-extending pivotal axis by means of a respective piston-and-cylinder unit 170.

Each intermediate rail guide assembly 168 includes a bearing housing 172 which is approximately cubicle in shape and includes opposite, open front and back ends 174, 176 with inwardly-converging frames 178. Each bearing housing 172 includes an inboard side 180 which mounts a lower hinge subassembly 182. Each bearing housing 172 is also pivotally connected to a respective piston-and-cylinder unit 170, which in turn is connected to a respective piston-and-cylinder unit mounting arm 184 which is mounted on and extends upwardly from a respective outrigger beam member 176. Extension and retraction of the piston-and-cylinder unit 170 rotates the intermediate rail guide assembly 168 about a rotational axis which extends generally longitudinally. The rails 110 can thus be aligned properly for placement on the ties 112.

Each rail guide assembly 168 further includes a rail press subassembly 186 having a hydraulic piston-and-cylinder unit 190 mounted on a subframe 192 located on a bearing housing top 188. The piston-and-cylinder unit 190 is connected to a clevis 194 which mounts an upper rail roller 196. A lower rail roller 198 is located in a lower portion of the bearing housing 172.

V. BRIDGING MEANS OR BRIDGE STRUCTURE 106

The bridge structure 106 includes a bridge frame 138 with a front end 140 and a rear end 141. The tractor means or bulldozer 105 is suitably linked in a towing configuration with the bridge frame front end 140 by a suitable tensile member 200, such as a steel cable (i.e., wire rope), chain or tow bar.

A bridge frame-to-railcar hinge mechanism 202 is mounted on the bridge frame rear end 141 and the railcar 107 and allows pivotal movement therebetween with respect to horizontal (i.e., transverse) and vertical axes whereby the bridging means 106 and the railcar 107 are articulated with respect to each other and can respond to curves, rises and dips in the roadbed 114.

The bridge frame 138 includes a pair of beams (e.g., box beams) 204 extending between the bridge frame ends 40, 41. A pair of gantry rails 203 extend along the tops of the bridge frame beams 204 and the railcar 107. The gantry rails 220 can include suitable transition sections 205 which extend between the bridge structure 106 and the supply railcar 107 for accommodating articulation therebetween, e.g., on curves, dips and rises.

A pair of rear rail guide assemblies 206 are positioned intermediate the bridge frame front and rear ends 140, 141. Each rear rail guide assembly 206 is mounted (e.g., by welding) on a respective bridge beam 204 and projects outwardly therefrom. The rear rail guide assemblies 206 can be vertically adjustably mounted on the bridge beams 204, but otherwise can be substantially similar to the intermediate rail guide assemblies 168 with suitable hydraulic clamping mechanisms.

A bridge frame crossbeam 142 extends transversely across the bridge frame front end 140 and can comprise, for example, a hollow box beam for use as a reservoir 143 for hydraulic fluid 144.

A bridge frame guide tractor 130 is mounted on the crossbeam 142 and generally includes a track unit 131 with tracks 132. The track unit 131 is pivotably mounted on an underside of the crossbeam 142 by a turntable bearing assembly 146 for rotational with respect to a generally vertical rotational axis. The guide tractor 130 also includes a power supply unit 134 mounted on top of the crossbeam 142 and including an engine 136 such as a diesel engine, for providing pressurized hydraulic fluid 144 to the tractor unit 131 in fluidic communication with the reservoir 143. The guide tractor 130 ca be used to steer the bridge structure 106 by differentially controlling the guide tractor tracks 132 from the cab of the bulldozer 105. The guide tractor 130 can be hydraulically linked to the bulldozer 105 by hydraulic lines 147 to provide hydraulic control of the guide tractor 130 by the bulldozer operator.

A rail spacing subsystem 360 is mounted on the bridge beams 204 and includes a rail spacing subsystem subframe 362 which mounts a pair of suspended rail guides 364, each of which rollingly engages the head of a respective rail 110 by means of a vertical positioning piston-and-cylinder unit 366 and a lateral positioning piston-and-cylinder unit 368. Vertical positioning piston-and-cylinder units 366 have upper ends 370 rollingly connected to transversely-extending guide tracks 372 for transverse or lateral movement as the lateral positioning piston-and-cylinder units 368 extend and retract. An operator station 374 is located in front of the rail spacing subsystem 360 with the operator facing rearwardly from a seat 376 with access to hydraulic controls 378 for hydraulically controlling the operation of the rail spacing subsystem 360, which can receive hydraulic power from the guide tractor 130. From the operator station 374, the operator can place the rail pads 120 on the ties 112 between the rail attachment brackets 118 for engagement by the rails 110.

With the rail spacing subsystem 360, the operator can relatively precisely control the spacing of the rails 110 as they are placed on the ties 112 ahead of the railcar 107.

VI. TIE SUPPLY MEANS OR RAILCAR 107

Figure 13:
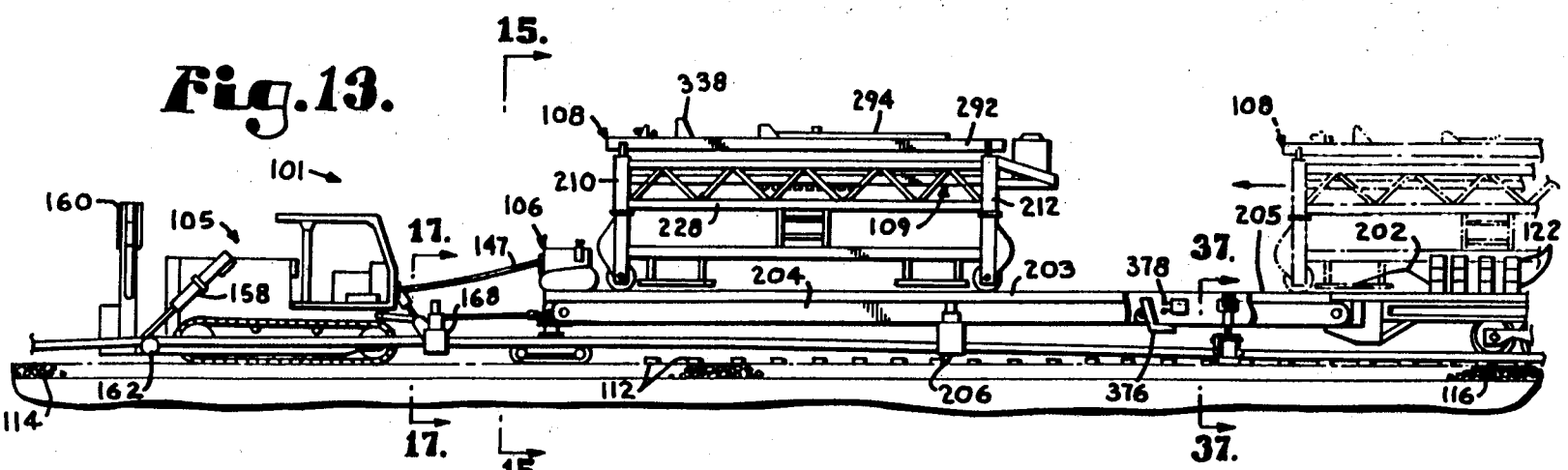
FIG. 13 is a side elevational view of a railroad track laying system embodying the present invention.
Figure 14:
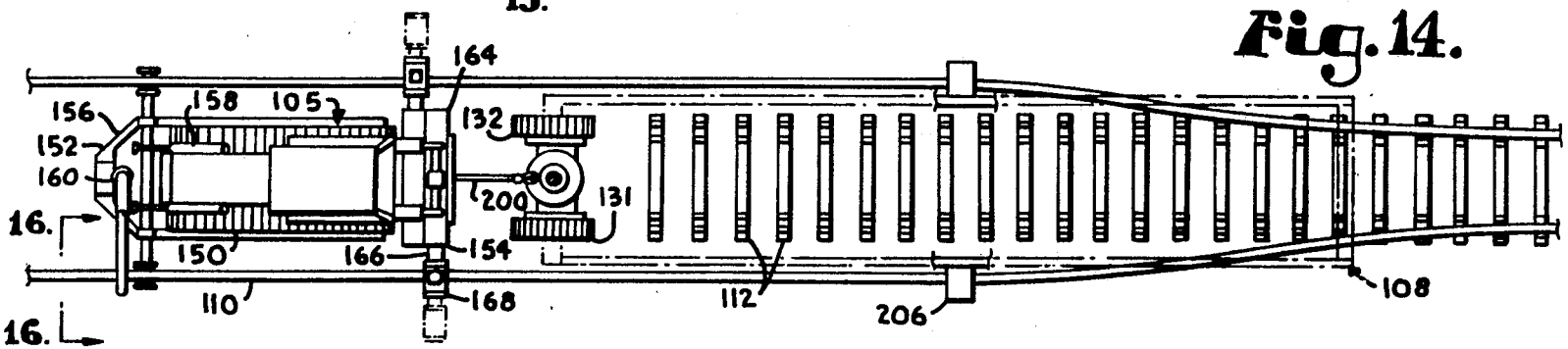
FIG. 14 is a top plan view of the system.

The first railcar of What can comprise a series of rail supply cars is partially shown in FIG. 13 and is designated by the reference numeral 107. The railcar 107 includes a front end 126 mounting the bridge frame-railcar hinge mechanism 202 and a front bogey 128. Ties 112 are stacked on the railcar 107 in multiple layers 122, each layer consisting of eleven juxtaposed ties. Other multiples of ties 112 could also be utilized, and a tie supply train consisting of a number of railcars 107 can be coupled together, each railcar 107 including a pair of gantry rails 203 for passage thereover by the gantry 108. The railcars 107 can include bulkheads which form bunkers for receiving the stacked railroad ties 112 in a manner which is known in the art.

VII. GANTRY 108

The gantry 108 includes front and back ends 210, 212, and generally comprises a superstructure 214, a gantry drive system 216, the railroad tie handling apparatus 109, and a positioning system 218 for the railroad tie handling apparatus 109.

VIIa. GANTRY SUPERSTRUCTURE 214

The superstructure 214 includes four corner posts 220, each of which can comprise an upper section **220*a* and a lower section 220*b***.

The corner post sections **220*a*, 220*b* of each corner post 220 are joined at a bolted flange connection 222. The corner posts 220 are interconnected along opposite gantry sides 224 by side truss members 226 which extend between respective pairs of corner post upper sections 220*a* and side beam members 228 which extend between respective pairs of corner post lower sections 220*b*. At the gantry ends 210, 212 end truss members 230 extend between and are connected to the corner post lower sections 220*b*. A pair of crossbeams 232 extend between and interconnect the corner post upper sections 220*a* at the gantry ends 210, 212 and at a gantry top 234. A pair of stop posts 236 extend upwardly from each crossbeam 232** in proximity to the ends thereof.

VIIb. GANTRY DRIVE SYSTEM 216

The gantry drive system 216 includes a gantry power unit 240 mounted on a gantry power unit subframe 242 which is mounted on the gantry back end 212 and extends rearwardly therefrom. Gantry power unit 240 provides pressurized hydraulic fluid for powering the railroad tie handling apparatus 109, the positioning system 218 therefore and the gantry drive system 216. The gantry power unit 240 can comprise, for example, a suitable internal combustion (e.g., diesel) engine driving coupled to a suitable hydraulic pump.

The gantry drive system 216 further includes a plurality (e.g., four) of drive subsystems, each mounted on a respective post lower section **220*b* and including a hydraulic motor 248 drivingly connected to a drive wheel 250 by a pair of sprockets 252*a*, 252*b* and a chain 254. The drive wheels 50 are flanged and ride on the gantry rails 230. A suitable safety cover 256 is mounted on a respective corner post lower section 220*b* in covering relation over portions of a drive subsystem 246, e.g., the hydraulic motor 248 and a portion of the chain 254**.

A plurality (e.g., four) of safety skids 258 are mounted on the side beam members 228 in proximity to the corner post lower sections **220*b* and are positioned in spaced relation slightly above the gantry rails. In the event the gantry 108 is driven off of the end of the gantry rails, the end of the gantry 108 will drop slightly and rest on a pair of safety skids 258 supported by the gantry rails, and further motion of the gantry 108 is prevented. Thus, the possibility of the gantry 108 being driven off of the end of the bridge structure 106 or one of the railcars 107** can be significantly reduced.

A brake mechanism 260 is mounted on each safety skid 258 and includes a pneumatic cylinder 262 engaging a brake shoe 264 by means of a brake lever arm 266 which can be pivotally mounted on the safety skid 258. Actuating the pneumatic cylinder 262 engages or releases the brake 264 with respect to the drive wheel 250.

The hydraulic motors 48 are fluidically connected to the gantry power unit 40 through suitable controls 268 which are accessible from a gantry operator's station 270 including a seat 272 mounted on one of the gantry sides 224 and projecting outwardly therefrom.

The brake mechanisms 260 function as parking brakes for securing the gantry 108 in position during transit of the railroad track laying system 101.

VIIc. PORTIONING SYSTEM FOR THE RAILROAD TIE HANDLING APPARATUS 218

A generally rectangular railroad tie handling apparatus suspension frame 282 includes front and back crossbars 284, a middle crossbar 286, front intermediate crossbars **288*a*, 288*b* and back intermediate crossbars 289*a*, 289*b* (FIG. 23). The suspension frame 282 includes cat walks 298*a*, 298*b* and 298*c*. A pair of pulley head guides 290 extend parallely between the middle crossbar 286 and the back intermediate crossbar 289*b*, and each comprises a lower box beam member 292 and an upper channel member 294 with an inwardly open channel 296**.

The positioning system 218 includes a lateral positioning subsystem 300 for lateral or transverse translation of the suspension frame 282 with respect to the gantry superstructure 214. A drive axle 302 extends longitudinally from the suspension frame ends and is journaled in the suspension frame crossbars **284*a*, 284*b*, 286, 288*a*, 288*b*, 289*a* and 289*b*. The drive axle 302 mounts flanged wheels 304 between respective crossbar pairs 284*a*, 288*a* and 284*b*, 289*a*. The drive axle 302 also mounts a pair of frame drive sprockets 306, each of which drivingly engages a respective chain section 308 mounted on top of a respective gantry superstructure crossbeam 232, and an axle drive sprocket 310 which is driven by an endless chain 312 by means of a motor sprocket 314 mounted on a hydraulic motor 316, which in turn is mounted on the front intermediate crossbar 288*a***.

Adjacent to the opposite side of the suspension frame 82, stub axles 318 extend between respective pairs of end and intermediate cross bars **284*a*, 288*a* and 284*b***, 289*a* and mount flanged wheels 304. The hydraulic motor 316 is reversible whereby the suspension frame 282 can be moved in either direction by means of the lateral positioning subsystem 300 described above. Travel of the suspension frame 282 is limited by the stop posts 236 (FIG. 29).

The railroad tie handling apparatus positioning system 218 further includes a vertical positioning subsystem 322, which comprises a hydraulic piston-and-cylinder unit 324 with a proximate front end 326 connected to the front intermediate cross bar 288*b* and a distal or back end 328 mounting a pulley head 330 consisting of a four-groove pulley 332 which is journaled in a pulley block 334, and guide rollers 336 for rollingly engaging the box beam and channel members 292, 294 (FIGS. 27 and 38).

A cable anchor bracket 338 is mounted on the front intermediate cross bar 288*b*, projects upwardly therefrom and also anchors the piston-and-cylinder unit proximate end 326. A cable guide bracket 340 is mounted on the middle cross bar 286, projects upwardly therefrom, and is penetrated and connected to the cylinder portion of the piston-and-cylinder unit 324.

A plurality (e.g., four) of front and back suspension cables 342*a*, 342*b* have proximate ends 344 anchored on the cable anchor bracket 338 and distal ends 346 which are connected to railroad tie handling apparatus 109.

The suspension cables 342*a*, 342*b* are reaved over the four-groove pulley 332, a four-groove return pulley 348 and a four-groove separating pulley 350. The return and separating pulleys 348, 350 are rotatably mounted between the box beam members 392 of the pulley head guides 390. The front suspension cables 342*a* extend forwardly to single-groove diverting pulleys 352 mounted on the front intermediate cross bar 289*a*, thence to single-groove downturn pulleys 354 mounted on the front intermediate cross bar 288*a*, and thence downwardly to the suspension frame 282.

The back suspension cables 342*b* are reaved on deflection pulleys 356 mounted on the box beam members 292, thence to diverting pulleys 352 mounted on the back intermediate cross bar 289*b* and thence to downturn pulleys 354 mounted on the back intermediate cross bar 289*a* and thence downwardly to the suspension frame 282. The hydraulic motor 316 and the piston-and-cylinder unit 324 are controlled by suitable hydraulic valve control levers at the operators station.

VIII. MULTIPLE TIE HANDLING APPARATUS 109

Referring to FIGS. 25, 26, and 30–33 the tie handling apparatus 109 for the track laying system 101 is similar in many respects to the multiple railroad tie handling apparatus 1. The apparatus 109 includes a rectangular tie handling frame 401 which supports a plurality of parallel tie lift support beams 402 mounted thereon, each beam 402 having a pair of tie engaging dogs 403 mounted thereunder to engage the brackets 118 on the ties 112. The beams 402 are connected by lazy tong or scissors linkages 404 which coordinate longitudinal translation of the beams 402 to maintain equal spacing between the beams 402 as the beams are spread and converged by the operation of tie spacing motors 405.

The tie handling frame 401 is formed by a pair of longitudinal side members 412 connected by transverse end cross members 413 and intermediate cross members 414. The side members 412 are illustrated as I-beams (FIG. 30) having a central web 417, an upper flange 418, and a lower flange 419 and form guide tracks for the tie support beams 402. An elongated stationary sprocket chain 421 extends along the upper surface 422 of the inner portion of the lower flange 419 of each of the members 412 and functions as a rack gear. Alternatively, more conventional rack gears could replace the chains 421.

Referring to FIGS. 30–33, the front and rear tie lift support beams 402 have drive brackets 425 mounted on each end thereof. The remaining beams 402 have guide brackets 426 of the opposite ends thereof. Each of the brackets 425 and 426 has a pair of flanged guide wheels 429 journaled thereon which engage the upper surfaces 422 and inner edges of the inner portions of the lower flanges 419 of the side members 412. Each of the brackets 425 and 426 has a sprocket 431 mounted coaxial with one of the flanged wheels 429 on the respective bracket and engaged with the sprocket chain 421. On all except the front and rear beams 402, the sprockets 431 are idler sprockets and, on opposite sides of each beam 402, are connected by a cross shaft 432. On one side each of the front and rear beams 402, the sprockets 431 are drive sprockets 435 and are mounted on drive shafts 436 which are engaged through a gear box 437 with the tie spacing motors 405. On the opposite ends of the front and rear beams 402 from the motors 405, the sprockets 431 function as idler sprockets. Each of the brackets 425 and 426 has a roller 433 journaled thereon in vertical alignment with one of the flanged wheels 429 and positioned to rollingly engage a lower surface 434 of the inner portion of the lower flange 419 of the side members 412. The portions of the side members 412 having the flanged wheels 429 and sprockets 431 therein may be closed by a ledges 440 connected as by welding to the webs 417 of the side members 412 and braced by brace plates 441.

The illustrated tie handling apparatus 109 has eleven tie support beams 402. A center beam 445 is fixed in place on the frame 401 by sets of stops or chocks 446 which engage the flanged wheels 429 of the center beam 445. Other means can alternatively be used to fix the position of the center beam 445. The lazy tong or scissors linkages 404 are formed by whole-length links 450, each of which are pivotally connected at midpoints thereof to the beams 402 and have the ends of the links 450 o adjacent beams 402 pivotally connected. On the front or rear end beams 402 half-length links 451 connect to the adjacent whole links 450. The illustrated apparatus 109 has a pair of laterally spaced linkages 404.

When the tie support beams 402 are in the converged or retracted configuration illustrated in FIG. 25, they may be spread by operation of the motors 405 to drive the drive sprockets 435 along the sprocket chains 421. The flanged wheels 429 and interconnected sets of idler sprockets 431 cooperate to maintain the beams 402 in a mutually parallel relation as the drive sprockets 435 move along the chains 421. The lazy tong linkages 404 act to maintain equal longitudinal spacing or inter-tie intervals between adjacent beams 402, in the same manner as the linkage arrangement 4 of the apparatus 1. End limit stops or chocks 455, which may be similar to the stops 446, may be provided to determine the maximum inter-tie spacing between the tie support beams 402 as the beams are spread. Alternatively, other means may be used to determine tie spacing, such as position sensors (not shown) associated with the drive sprockets 435.

Referring to FIGS. 33-36, each tie support beam has a pair of legs 460 depending therefrom with a foot 461 on the end thereof. The legs 460 are positioned laterally and the feet 461 are sized to engage resilient pads 462 between the brackets 118 on the ties 112 on which the rails 110 rest when installed. Laterally spaced pairs of the tie engaging dogs 403 are pivotally supported below each tie support beam 402 by ears 463 (FIG. 35). The dogs 403 on each beam 402 are interconnected by a tie engaging cylinder 465 pivotally connected between the dogs 403. Each tie engaging dog 403 has a tapered cleat 470 at an outer end thereof which is sized to fit within the tie brackets 118.

The brackets 118, referred to as McKay brackets, are provided on the ties 112 during manufacture thereof and receive fasteners which connect the rails 110 to the ties 112. Each bracket 118 has an inwardly turned lip 471 at a position spaced upward from the upper surface of the tie 112 which is engaged by the cleat 470. As illustrated in FIG. 34, the cylinders 465 are retracted to angle the dogs 403 inwardly when the beams 402 are rested on the ties 112. The cylinders 465 are extended to engage the cleats 470 beneath the lips 471 of the brackets 118 (FIG. 35). By this means, the ties 112 are engaged by the tie handling apparatus 109 and may be securely lifted. When the ties 112 are placed on the roadbed 114, the ties 112 may be released by retracting the tie engaging cylinders 465 to withdraw the cleats 470 from the brackets 118.

Referring to FIG. 26, the tie handling frame 401 is provided with means such as ears or clevises 475 on the upper surfaces of the side members 412 near the ends thereof for the connection of the cables 342 (FIG. 15) between the frame 401 and the gantry 108 to suspend the frame 401 therefrom for lifting and lowering the tie handling apparatus 109.

It is to be understood that while certain forms of the present invention have been illustrated and described herein, it is not to be limited to the specific forms or arrangement of parts described and shown.

What is claimed and desired to be secured by Letters Patent is as follows:

1. A system for laying railroad ties and railroad tracks on a roadbed, which comprises:

(a) tractor means for pulling said system along the roadbed, said tractor means including tractor rail guide means;

(b) a railcar including means for transporting thereon a layer of juxtaposed railroad ties, said railcar including a front end and a front bogey rollingly engaging rails laid by the system;

(c) bridging means for bridging between the tractor means and the railcar, the bridging means including bridge rail guide means for guiding the rails;

(d) a gantry including gantry drive means for driving longitudinally over the railcar and the bridging means; and (e) a tie handling apparatus vertically movably mounted on the gantry and including tie engagement means for selectively engaging and releasing a layer of ties and tie spreading means for spreading the layer of ties.

2. The invention of claim 1, which includes:

(a) the tractor means generally comprising a bulldozer; and (b) tensile connector means interconnecting said bulldozer and said bridging means for towing the track laying system along the roadbed with the bulldozer.

3. The invention of claim 1, which includes:

(a) said bulldozer including a tractor front rail handling system having tractor front rail guide means and a rear rail handling system including tractor rear rail guide means.

4. The invention of claim 3, which includes:

(a) the front rail handling system comprising a sled base movable between raised and lowered positions, a crane mounted on the sled base and including rail lifting means, and a pair of rail guide rollers each mounted on a respective side of the sled base.

5. The invention of claim 3 wherein the rear rail handling system includes a pair of laterally extendable beam members each extendable from a respective side of the rear rail handling system, each beam member mounting a respective tractor rear rail guide means.

6. The invention of claim 5 wherein each said tractor rear rail guide assembly includes means for pivoting same with respect to an axis extending generally longitudinally with respect to the system.

7. The invention of 1 wherein the bridging means includes:

(a) a bridge frame with front and back ends;

(b) a pair of bridge beams extending between the bridging frame front and back ends; and (c) a bridge frame guide tractor connected to and supporting the bridge frame front end.

8. The invention of claim 7, which includes:

(a) said bridge frame having a crossbeam extending transversely between said bridge beams at said bridge frame front end;

(b) said bridge frame guide tractor including a track unit rotatably mounted on an underside of said crossbeam and including a pair of tracks which can be independently and differentially driven; and (c) a power supply unit mounted on top of said crossbeam and connected to said track unit in a power-exchange relationship therewith.

9. The invention of claim 8 wherein:

(a) said guide tractor tracks are hydraulically driven;

(b) said power supply unit includes hydraulic power supply means; and (c) said bridge frame crossbeam comprises a hollow box beam including a hydraulic fluid reservoir fluidically communicating with said track unit and said power supply unit.

10. The invention of claim 7, which includes:

(a) pivotal connection means pivotally mounting the bridge frame back end to the railcar front end.

11. The invention of claim 7, which includes:

(a) a pair of bridge frame rail guide assemblies each mounted on the outside of a respective bridge frame beam.

12. The invention of claim 7 wherein the bridging means includes:

(a) a rail spacing subsystem mounted on said bridge frame between said bridge frame beams and including a pair of suspended rail guides, a pair of vertical positioning means each connected to a respective suspended rail guide and a pair of lateral positioning means each connected to a respective suspended rail guide.

13. The invention of claim 12 wherein said rail spacing subsystem includes:

(a) each said vertical positioning means comprising a piston-and-cylinder unit;

(b) each said lateral positioning means comprising a piston-and-cylinder unit; and (c) an operator station positioned generally below the box beams over the roadbed, the operator station including hydraulic controls for the rail spacing subsystem piston-and-cylinder units.

14. The invention of claim 1, which includes:

(a) said gantry having a superstructure with four corner posts and four gantry drive subsystems each mounted on a respective corner post.

15. The invention of claim 14 wherein said gantry includes:

(a) a suspension frame mounted on said superstructure; and (b) means for suspending said railroad tie handling apparatus from said suspension frame.

16. The invention of claim 15, which includes:

(a) a lateral positioning subsystem for laterally positioning said suspension frame, said lateral positioning subsystem including wheel means mounted on said suspension frame and rollingly engaging said gantry superstructure; and (b) drive means for driving said suspension frame laterally with respect to said gantry superstructure.

17. The invention of claim 16, wherein said suspension frame lateral drive means includes:

(a) a pair of chain sections each mounted on said gantry superstructure in proximity to a respective end thereof;

(b) a drive axle extending longitudinally along said suspension frame;

(c) a pair of sprockets each drivingly mounted on said drive axle and engaging a respective chain section; and (d) a hydraulic motor drivingly connected to said drive axle.

18. The invention of claim 15, which includes:

(a) vertical positioning means for lowering said railroad tie handling apparatus with respect to said suspension frame.

19. The invention of claim 18, which includes:

(a) said vertical positioning means comprising a hydraulic piston-and-cylinder unit mounted on said suspension frame; and (b) a plurality of cables each connected to said piston-and-cylinder unit and to said railroad tie handling apparatus.

20. The invention of claim 19, which includes:

(a) pulley means mounted on said suspension frame, said pulley means receiving said multiple cables.

21. A system for laying railroad ties and rails on a roadbed, which comprises:

(a) tractor means for pulling said system along the roadbed, said tractor means including:

(1) a front rail handling system including a sled base movable between raised and lowered positions, a crane mounted on the sled base and a pair of rail guide rollers each mounted on a respective side of the sled base and projecting laterally outwardly therefrom;

(2) a rear rail handling system including a rear platform movable between raised and lowered positions, a pair of outrigger beam members each extending laterally outwardly from a respective rear platform side, each said outrigger beam member being laterally extendable and retractable and a pair of tractor means rear rail guide assemblies each pivotally mounted on a respective outrigger beam member and pivotable with respect to a pivotal axis extending generally longitudinally with respect to the system;

(b) a bridge structure including:

(1) a bridge frame including front and back ends;

(2) said bridge frame including a pair of bridge beam members and a crossbeam extending between said bridge frame beams at said bridge structure front end;

(3) a bridge frame guide tractor including a track unit having a pair of independently and differentially drivable tracks and rotatable mounting means for rotatably mounting the track unit on the underside of the bridge frame crossbeam;

(4) the bridge frame guide tractor also including a power supply unit mounted on top of said bridge frame crossbeam and hydraulically connected to said bridge frame guide tractor track unit;

(5) a pair of bridge frame rail guide assemblies each mounted on and projecting laterally outwardly from a respective bridge frame beam; and (6) a rail spacing subsystem including a pair of suspended rail guides each longitudinally movably receiving a respective rail, a pair of vertical positioning means each adapted to vertically position a respective suspended rail guide and a pair of lateral positioning means each adapted to laterally position a respective suspended rail guide;

(c) a railcar including:

(1) a front end;

(2) a front bogey mounted in proximity to said front end and rollingly engaging railroad track rails laid by the system;

(3) means for supporting a layer of juxtaposed railroad ties thereon in generally transverse relation;

(d) tensile member means interconnecting said tractor means and said bridge frame front end for towing the bridge structure;

(e) bridge frame-to-railcar pivotal interconnection means for pivotably interconnecting the bridge frame rear end and the railcar front end;

(f) a pair of gantry rails extending in parallel, spaced relation along the bridge frame beams and the railcar;

(g) a gantry including:

(1) a superstructure including four corner posts;

(2) four gantry drive mechanisms each mounted on a respective gantry superstructure corner post;

(3) a railroad tie handling apparatus suspension frame laterally movably mounted on top of said gantry superstructure;

(4) a lateral positioning subsystem for laterally adjustably positioning said suspension frame with respect to said gantry superstructure;

(5) a railroad tie handling apparatus vertical positioning subsystem mounted on the suspension frame;

(6) an operator station mounted on the superstructure and including controls for the gantry drive mechanisms, the railroad tie handling apparatus lateral subsystem and the railroad tie handling apparatus vertical positioning subsystem; and (h) a railroad tie handling apparatus, which includes:

(1) a frame with opposite sides and opposite ends;

(2) a plurality of tie engagement support means mounted on said frame to enable movement of said support means toward and away from said (3) each support means having a pair of tie engagement members mounted thereon to enable movement of each tie engagement members between an engagement position to engage a railroad tie and a release position to release a tie;

(4) each support means having tie engagement motor means connected between said support means and said tie engagement members thereon and operable to move said tie engagement members between said engagement and release positions;

(5) lazy tong linkage means interconnecting said support means in such a manner as to maintain a mutually parallel relation among said support means and an equal spacing between adjacent support means upon movement of said support means relative to said ends of said frame;

(6) spacing motor means operatively connected to said support means and operable to spread said support means to a selected tie interval spacing between adjacent support members for deposit of ties supported thereby onto said track bed and to converge said support means to engage a plurality of said ties; and (7) frame position means connected to said frame and operable to lift and lower said frame and to position said frame between a position over said track bed and a tie supply position.

22. A method of laying railroad ties and rails on a roadbed, which comprises the steps of:

(a) providing tractor means for pulling the system along the roadbed;

(b) passing the rails through tractor rail guide means mounted on the tractor means;

(c) connecting the tractor means to bridging means in a towing relationship;

(d) providing the bridging means with a bridge frame including front and back ends and a pair of parallel, bridge frame members extending between the bridge frame front and back ends;

(e) mounting a bridge frame guide tractor on the bridge frame front end;

(f) providing the bridge frame guide tractor with a track unit including a pair of tracks;

(g) independently and differentially driving the bridge frame guide tractor track unit tracks; r (h) providing a pair of gantry rails on top of the bridge frame beams and the railcar;

(i) longitudinally movably placing a gantry with a superstructure on the gantry rails;

(j) laterally movable mounting a railroad tie handling apparatus suspension frame on the gantry superstructure;

(k) suspending a railroad tie handling apparatus from the suspension frame;

(l) engaging a layer of juxtaposed railroad ties on the railcar with the railroad tie handling apparatus;

(m) raising the layer of railroad ties;

(n) spreading the railroad tie;

(o) lowering the railroad to the roadbed; and (p) releasing the railroad ties from the railroad tie handling apparatus.

* * * * *